US008730146B2

(12) United States Patent
Lee

(10) Patent No.: US 8,730,146 B2
(45) Date of Patent: May 20, 2014

(54) DRIVE VOLTAGE GENERATING CIRCUIT AND LIQUID CRYSTAL DISPLAY INCLUDING THE SAME

(75) Inventor: Yong-Soon Lee, Cheonan-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 686 days.

(21) Appl. No.: 12/539,032

(22) Filed: Aug. 11, 2009

(65) Prior Publication Data

US 2010/0039364 A1 Feb. 18, 2010

(30) Foreign Application Priority Data

Aug. 12, 2008 (KR) ..... 10-2008-0078975

(51) Int. Cl.
*G09G 3/36* (2006.01)

(52) U.S. Cl.
USPC ..... 345/101

(58) Field of Classification Search
USPC ..... 345/101, 204
See application file for complete search history.

(56) References Cited

U.S. PATENT DOCUMENTS

| | | | | |
|---|---|---|---|---|
| 4,687,956 | A * | 8/1987 | Itoh et al. | 345/101 |
| 6,919,883 | B2 | 7/2005 | Lee | |
| 7,403,186 | B2 | 7/2008 | Lee | |
| 7,928,973 | B2 | 4/2011 | Oku et al. | |
| 8,018,451 | B2 | 9/2011 | Park | |
| 2001/0040543 | A1 | 11/2001 | Lee | |
| 2004/0239655 | A1 * | 12/2004 | Tani et al. | 345/101 |
| 2005/0139829 | A1 | 6/2005 | Lee | |
| 2007/0035501 | A1 * | 2/2007 | Moh | 345/101 |
| 2007/0216671 | A1 | 9/2007 | Oku et al. | |
| 2008/0054987 | A1 * | 3/2008 | Choi et al. | 327/512 |
| 2008/0062100 | A1 * | 3/2008 | Hong et al. | 345/87 |
| 2008/0122829 | A1 | 5/2008 | Park | |
| 2009/0102779 | A1 * | 4/2009 | Jo | 345/101 |

FOREIGN PATENT DOCUMENTS

| | | | |
|---|---|---|---|
| CN | 1912695 | A | 2/2007 |
| JP | 2001-228836 | | 8/2001 |
| JP | 2006-259034 | | 9/2006 |
| JP | 200747790 | A | 2/2007 |
| JP | 2007-089256 | | 4/2007 |
| JP | 2007-256344 | | 10/2007 |

(Continued)

OTHER PUBLICATIONS

English Abstract for Publication No. 10-031204.
English Abstract for Publication No. 2001-228836.
English Abstract for Publication No. 2005-259034.

(Continued)

*Primary Examiner* — Kevin M Nguyen
(74) *Attorney, Agent, or Firm* — F. Chau & Associates, LLC

(57) ABSTRACT

A drive voltage generating circuit which has a first shifter receiving an input voltage and outputting a first drive voltage obtained by first shifting a voltage level of the input voltage; a second shifter receiving outputting the second drive voltage obtained by second shifting a voltage level of the first drive voltage; and a drive voltage controller adjusting one of a shifting amount of the first shifter and a shifting amount of the second shifter in accordance with a surrounding temperature, wherein the second drive voltage is continuously varied in an analog manner, in accordance with the surrounding temperature.

16 Claims, 20 Drawing Sheets

(56) References Cited

FOREIGN PATENT DOCUMENTS

| | | | |
|---|---|---|---|
| JP | 2008-020911 | | 1/2008 |
| JP | 2008-134589 | | 6/2008 |
| JP | 10-031204 | | 8/2013 |
| KR | 1020030034584 | | 5/2003 |
| KR | 1020050019311 | A | 3/2005 |
| KR | 20070018279 | A | 2/2007 |
| KR | 1020070064447 | | 6/2007 |

OTHER PUBLICATIONS

Engush Abstract for Publication No. 2007-256344.
English Abstract for Publication No. 2008-020911.
English Abstract for Publication No. 2008-134589.
Japanese Office Action Dated May 28, 2013.
Chinese Office Action—issuance date Aug. 13, 2012 and its English translation.

* cited by examiner

DRIVE VOLTAGE GENERATING CIRCUIT AND LIQUID CRYSTAL DISPLAY INCLUDING THE SAME

CROSS-REFERENCE TO RELATED APPLICATION

This application is based on and claims priority from Korean Patent Application No. 10-2008-0078975, filed on Aug. 12, 2008 in the Korean Intellectual Property Office, the disclosure of which is incorporated by reference herein in its entirety.

BACKGROUND OF THE INVENTION

1. Technical Field

The present disclosure relates to a drive voltage generating circuit and a liquid crystal display including the same and, more particularly to a drive voltage generating circuit and a liquid crystal display including the same that can reduce the manufacturing cost and improve the display quality.

2. Discussion of the Prior Art

A liquid crystal display (LCD) includes a liquid crystal panel provided with a plurality of gate lines and a plurality of data lines, a gate driver outputting gate signals to the gate lines, and a data driver outputting data signals to the data lines.

Conventionally, a gate driver is implemented by packaging a gate driver integrated circuit in the form of a TCP (Tape Carrier Package) or COG (Chip On the Glass). Recently, in consideration of the manufacturing cost, size, and design of the product, another method has been sought. That is, a gate driver generating gate signals by using amorphous silicon thin film transistors (hereinafter referred to as "a-Si TFT") has been packaged on the liquid crystal panel.

The gate driver packaged on the liquid crystal panel includes a plurality of stages each of which includes at least one a-Si TFT.

The driving capability of the a-Si TFT changes depending on the surrounding temperature. More specifically, if the temperature is lowered, the driving capability is deteriorated, and thus it is impossible for the a-Si TFT to output a gate signal having a voltage level sufficient to turn on/off a switching transistor in a pixel. Such a gate signal is generated using a clock signal and a clock bar signal provided to the gate driver, and the clock signal and the clock bar signal swing between a gate-on voltage level and a gate-off voltage level.

Accordingly, there is a need for a liquid crystal display that can adjust the gate-on voltage level and the gate-off voltage level in accordance with the surrounding temperature.

SUMMARY OF THE INVENTION

A drive voltage generating circuit is provided, according to an exemplary embodiment of the present invention, which includes a first shifter receiving an input voltage and outputting a first drive voltage obtained by first shifting a voltage level of the input voltage; a second shifter outputting a second drive voltage obtained by second shifting a voltage level of the first drive voltage; and a drive voltage controller adjusting one of a shifting amount of the first shifter and a shifting amount of the second shifter in accordance with a surrounding temperature, wherein the second drive voltage is varied in relation to changes in the surrounding temperature.

In an exemplary embodiment of the present invention, there is provided a liquid crystal display, which includes a first shifter receiving an input voltage and outputting a first drive voltage obtained by first shifting a voltage level of the input voltage, a second shifter outputting a second drive voltage obtained by second shifting a voltage level of the first drive voltage, and a drive voltage controller adjusting one of a shifting amount of the first shifter and a shifting amount of the second shifter in accordance with a surrounding temperature, wherein the second drive voltage is continuously varied in an analog manner, in accordance with the surrounding temperature; a gate driver outputting a gate signal generated by using the second drive voltage; and a plurality of pixels being turned on/off in accordance with the gate signal from the gate driver and displaying an image.

BRIEF DESCRIPTION OF THE DRAWINGS

Exemplary embodiments of the present invention will be understood in more detail from the following detailed descriptions taken in conjunction with the accompanying drawings, in which.

DETAILED DESCRIPTION OF EXEMPLARY EMBODIMENTS

Figure 1:
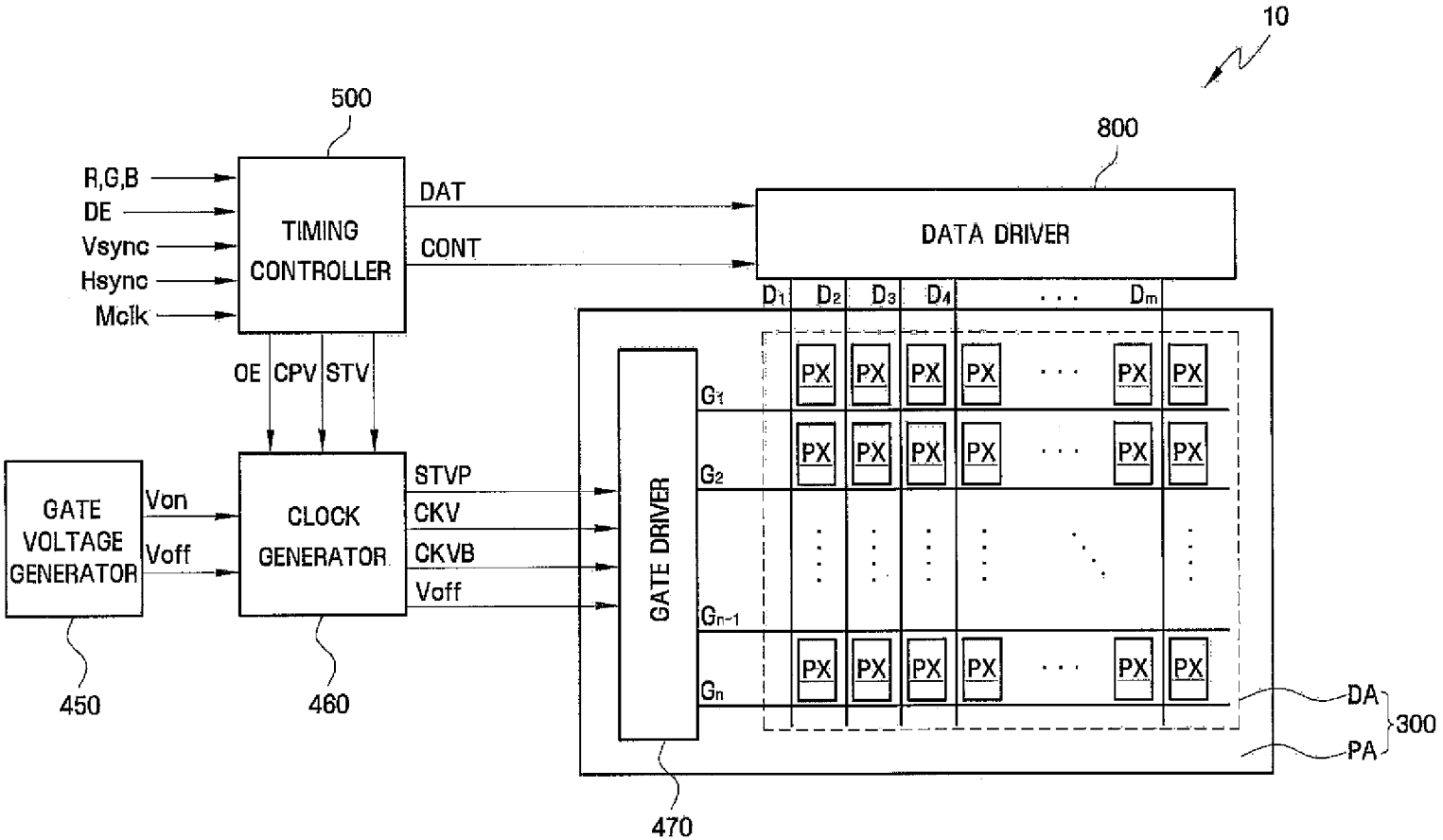
FIG. 1 is a block diagram illustrating the configuration of a liquid crystal display according to exemplary embodiments of the present invention.

Hereinafter, exemplary embodiments of the present invention will be described in detail with reference to the accompanying drawings. The aspects and features of the present invention and methods for achieving the aspects and features will be apparent by referring to the exemplary embodiments to be described in detail with reference to the accompanying drawings. The present invention is not limited to the exemplary embodiments disclosed hereinafter, but can be implemented in diverse forms. The matters defined in the description, such as the detailed construction and elements, are nothing but specific details provided to assist those of ordinary skill in the art in a comprehensive understanding of the invention, and the present invention is only defined within the scope of the appended claims. In the entire description of the present invention, the same drawing reference numerals are used for the same elements across various figures.

Hereinafter, a liquid crystal display according to an exemplary embodiment of the present invention will be described with reference to FIGS. 1 to 14.

Figure 2:
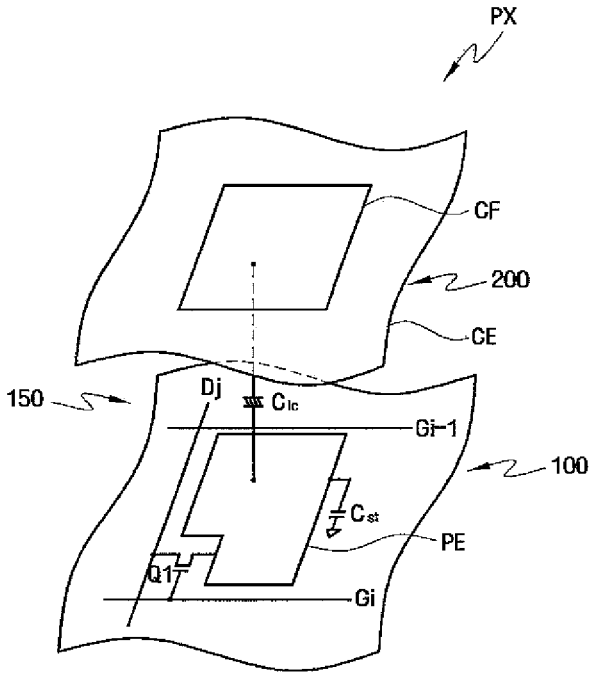
FIG. 2 is an equivalent circuit diagram of one pixel included in a liquid crystal display of FIG. 1.

FIG. 1 is a block diagram illustrating the configuration of a liquid crystal display according to an exemplary embodiment of the present invention, and FIG. 2 is an equivalent circuit diagram of one pixel included in a liquid crystal display of FIG. 1.

Referring to FIG. 1, the liquid crystal display 10 includes a liquid crystal panel 300, a drive voltage generator 450, a timing controller 500, a clock generator 460, a gate driver 470, and a data driver 800.

The liquid crystal panel 300 may be divided into a display area DA and a non-display area PA.

The display area DA includes a plurality of gate lines G1 to Gn, a plurality of data lines D1 to Dm, a first substrate (See 100 of FIG. 2) formed of a switching element (See Q1 of FIG. 2) and a pixel electrode (See PE of FIG. 2), a second substrate (See 200 of FIG. 2) formed of a color filter (See CF of FIG. 2) and a common electrode (See CE of FIG. 2), and a liquid crystal molecule layer (See 150 of FIG. 2) interposed between the first substrate and the second substrate. The gate lines G1 to Gn, which are parallel to one another, are extended roughly in a row direction, and the data lines D1 to Dm, which are parallel to one another, are extended roughly in a column direction.

With reference to FIG. 2, one pixel of FIG. 1 will be described. On a part of the common electrode CE of the second substrate 200, the color filter CF is formed to face the pixel electrode PE of the first substrate 100. For example, a pixel PX, which is connected to the i-th (where, i=1, 2, . . . , n) gate line Gi and the j-th (where, j=1, 2, . . . , m) data line Dj, includes a switching element Q1 connected to signal lines G1 and Dj, a liquid crystal capacitor Clc and a storage capacitor Cst connected to the switching element Q1. When desired, the storage capacitor Cst may be omitted. The switching element Q1 is a TFT made of a-Si (amorphous-silicon).

The non-display area PA is an area where no image is displayed due to the first substrate 100 being wider than the second substrate 200. The gate driver 470 may be packaged on the non-display area PA.

The drive voltage generator 450 generates the drive voltage and provides the drive voltage to the clock generator 460. Here, the drive voltage may be a gate-on voltage Von and a gate-off voltage Voff. Hereafter, it is assumed that the drive voltage is a gate-on voltage Von or a gate-off voltage Voff and the drive voltage generator 450 is a gate-on voltage generator or a gate-off voltage generator. The drive voltage generator 450 can be applied to various drive voltage generating circuit not limited to the gate-on voltage Von and the gate-off voltage Voff.

The gate voltage generator 450 generates and provides an input gate-on voltage Von and a gate-off voltage Voff to the clock generator 460. Voltage levels of the gate-on voltage Von and/or the gate-off voltage Voff may vary in accordance with the surrounding temperature. For example, the voltage level of the gate-on voltage Von increases at low temperature and decreases at high temperature. By contrast, the voltage level of the gate-off voltage Voff decreases at low temperature and increases at high temperature. The gate voltage generator 450 will be described in more detail through respective exemplary embodiments of the present invention to be described hereinbelow.

The timing controller 500 receives input image signals R, G, and B and input control signals for controlling the display of the image signals from an external graphic controller (not illustrated). The input control signals include a vertical sync signal Vsync, a horizontal sync signal Hsync, a main clock signal Mclk, and a data enable signal DE.

The timing controller 500 generates a data control signal CONT based on the input image signals R, G, and B and the input control signals, and sends the data control signal CONT and an image data signal DAT to the data driver 800.

Also, the timing controller 500 provides a first clock generation control signal OE, a second clock generation control signal CPV, and a source scan start signal STV to the clock generator 460. In this exemplary embodiment, the first clock generation control signal OE may be a signal for enabling the gate signal, and the second clock generation control signal may be a signal for determining a duty rate of the gate signal. The source scan start signal STV may be a signal for reporting the start of one frame.

The clock generator 460, in response to the first clock generation control signal OF, the second clock generation control signal CPV, and the source scan start signal STV, outputs a clock signal CKV, a clock bar signal CKVB, and the gate-off voltage Voff by using the gate-on voltage Von and the gate-off voltage Voff provided from the gate voltage generator 450. In this exemplary embodiment, the clock signal CKV and the clock bar signal CKVB are signals that swing between the gate-on voltage Von and the gate-off voltage Voff and have phases opposite to each other.

The clock generator 460 converts the source scan start signal STV into a scan start signal STVP and provides the scan start signal STVP to the gate driver 470. In this exemplary embodiment, the scan start signal STVP is a signal obtained by increasing the amplitude of the source scan start signal STV. When the surrounding temperature is lowered, the clock generator 460 outputs the clock signal CKV and the clock bar signal CKVB having an increased amplitude, while when the surrounding temperature is heightened, it outputs the clock signal CKV and the clock bar signal CKVB having a decreased amplitude. By increasing/decreasing the voltage level of the gate-on voltage Von and/or the gate-off voltage Voff in accordance with the surrounding temperature, the amplitude of the clock signal CKV and the clock bar signal CKVB can be adjusted.

The gate driver 470, which is enabled by the scan start signal STVP, generates a plurality of gate signals by using the clock signal CKV, the clock bar signal CKVB, and the gate-off voltage Voff, and provides the gate signals to the gate lines G1 to Gn, respectively. The details of the gate driver 470 will be described later with reference to FIGS. 12 to 14.

The data driver 800 receives the image data signal DAT and the data control signal CONT from the timing controller 500, and provides an image data voltage corresponding to the image data signal DAT to the respective data lines D1 to Dm. In this exemplary embodiment, the data control signal CONT is a signal for controlling the operation of the data driver 800, and includes a horizontal start signal, a load signal for instructing an output of two data voltages, and the like.

The data driver 800, which is an integrated circuit, may be connected to the liquid crystal panel 300 in the form of a TCP (Tape Carrier Package). The data driver 800 is not limited thereto, but may be formed on the non-display area PA of the liquid crystal panel 300.

Figure 3:
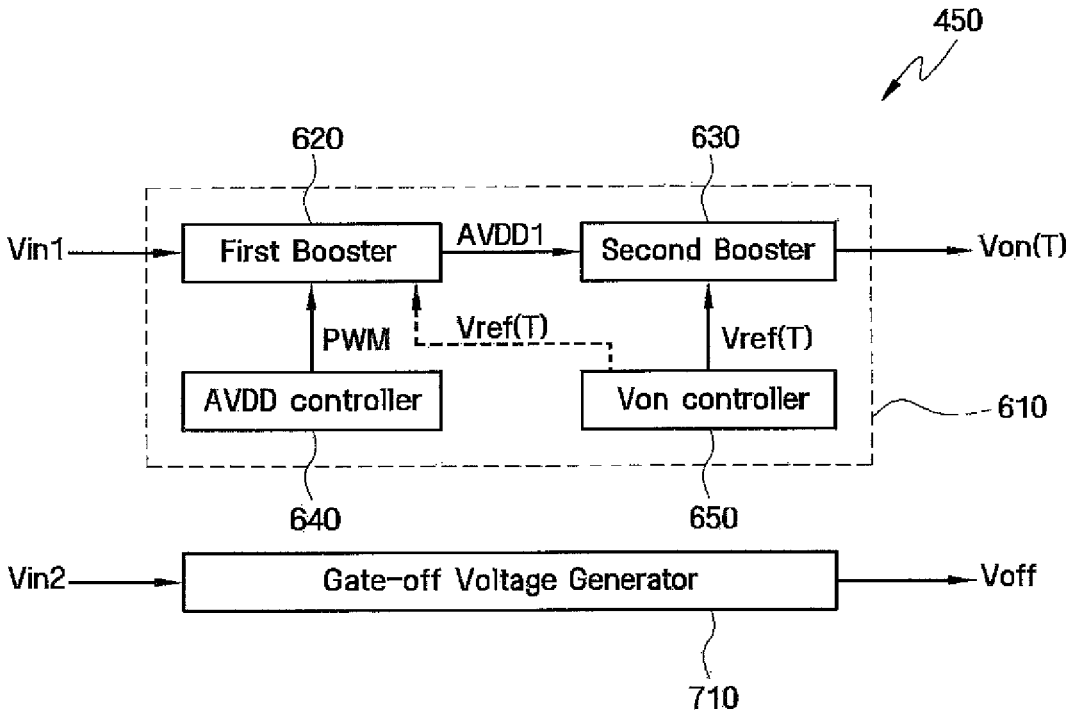
FIG. 3 is a block diagram illustrating the configuration of a gate voltage generator of FIG. 1 that is included in a liquid crystal display according to an exemplary embodiment of the present invention.

FIG. 3 is a block diagram illustrating the configuration of a gate voltage generator of FIG. 1 that is included in a liquid crystal display according to an exemplary embodiment of the present invention.

Referring to FIG. 3, the gate voltage generator 450 includes a gate-on voltage generator 610 and a gate-off voltage generator 710. The gate-on voltage generator 610 receives a first input voltage Vin1 and outputs a gate-on voltage Von(T). The gate-off voltage generator 710 receives a second input voltage Vin2 and outputs a gate-off voltage Voff. In this exemplary embodiment, the first input voltage Vin1 and the second input voltage Vin2 may be the same voltage Vin. Also, the reason why the gate-on voltage is indicated by Von(T) is that the voltage level of the gate-on voltage may vary in accordance with the surrounding temperature.

The gate-on voltage generator 610 includes a first shifter or booster 620, a second shifter or booster 630, and a second drive voltage controller 650. Hereafter, it is assumed that the second drive voltage controller 650 is a gate-on voltage (Von) controller.

The first shifter 620 receives the first input voltage Vin1 and outputs a first drive voltage AVDD1 obtained by shifting, for example, the voltage level of the first input voltage Vin1. The second shifter 630 outputs a second drive voltage obtained by shifting, for example boosting, the voltage level of the first drive voltage AVDD1. Here, the second drive voltage can be a gate on voltage Von(T).

The gate-on voltage controller 650 can adjust one of a shifting amount of the first shifter 620 and a shifting amount of the second shifter 630 in accordance with a surrounding temperature. According to the shifting amounts, gate on voltage Von(T) is continuously varied in an analog manner, in accordance with the surrounding temperature.

Also, the gate-on voltage controller 650 includes a variable element having a resistance value that is varied in accordance with the surrounding temperature, and adjusts a boost amount of the first shifter 620 or a boost amount of the second shifter 630. The gate-on voltage controller 650 may adjust the boost amount of the first shifter 620 as shown by the broken line arrow Vref(T) from the gate-on voltage controller 650 to the first shifter 620 in FIG. 3 or adjust the boost amount of the second shifter 630 by outputting a reference voltage Vref(T) having a voltage level that is changed in accordance with the surrounding temperature. FIG. 3 shows that the gate-on voltage controller 650 adjusts the boost amount of the second shifter 630. Although it is exemplified that, for convenience in explanation, the gate-on voltage controller 650 adjusts the boost amount of the second shifter 630 as shown in FIG. 3, it will be apparent that the present invention is not limited thereto.

The gate-on voltage generator 610 may further include a first drive voltage controller 640. As described above, in the case where the gate-on voltage controller 650 adjusts the boost amount of the second shifter 630, the first drive voltage controller 640 controls the first shifter 620 to perform shifting, for example boosting, of the voltage level of the first input voltage Vin1 to a first drive voltage AVDD1 by outputting a PWM signal to the first shifter 620. The first shifter 620, the second shifter 630, the first drive voltage controller 640 and the second drive voltage controller 650 may be formed on a single chip.

Figure 4:
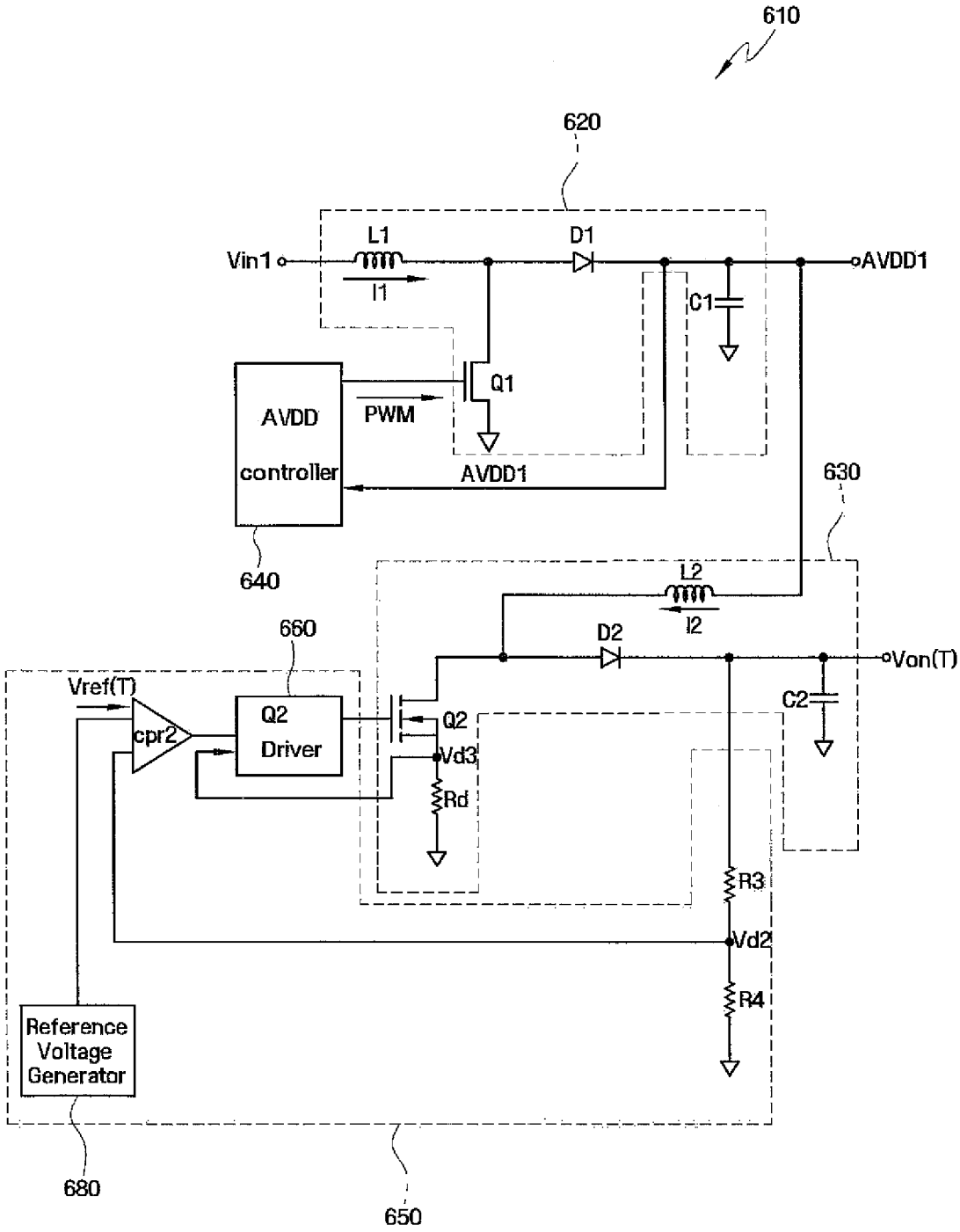
FIG. 4 is a circuit diagram illustrating the configuration of a gate-on voltage generator of FIG. 3.
Figure 5:
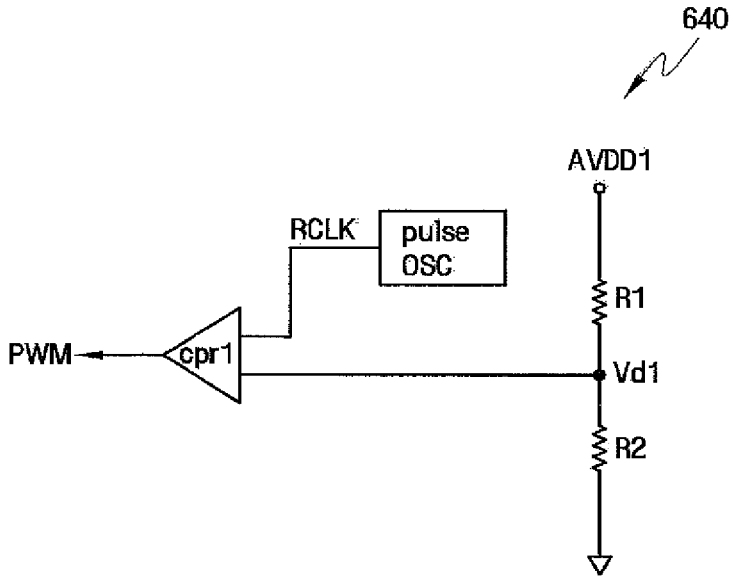
FIG. 5 is a circuit diagram illustrating the configuration of an AVDD controller of FIG. 4.
Figure 6:
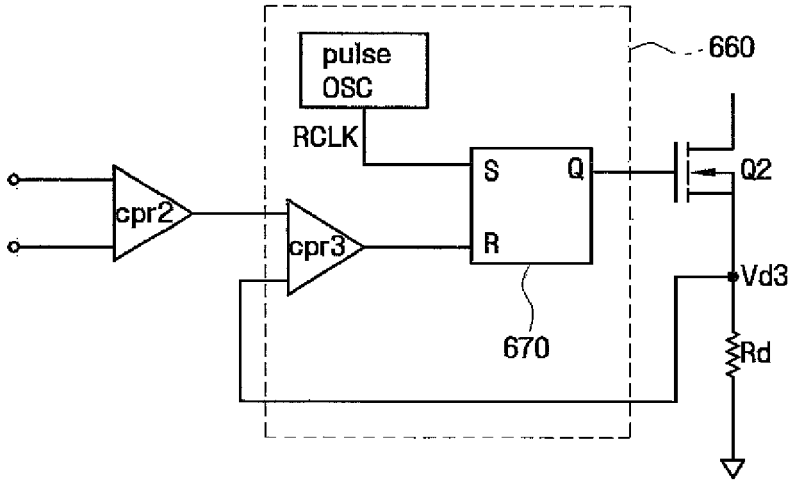
FIG. 6 is a block diagram illustrating the configuration of a switching driver of FIG. 4.

FIG. 4 is a circuit diagram illustrating the configuration of a gate-on voltage generator 610 of FIG. 3, FIG. 5 is a circuit diagram illustrating the configuration of an AVDD controller 640 of FIG. 4, and FIG. 6 is a block diagram illustrating the configuration of a switching driver of FIG. 4.

Referring to FIGS. 4 to 6, the gate-on voltage generator 610 includes a first shifter 620, an AVDD controller 640, a second shifter 630, and a gate-on voltage controller 650.

The first shifter 620 and the second shifter 630 may be boost converters as shown in FIG. 4. The boost converter may be a kind of a DC-to-DC converter, and the first shifter 620 and the second shifter 630 may comprise other kinds of converters as well.

The first shifter 620 includes an inductor L1 to which the first input voltage Vin1 is applied, a diode D1 having the anode connected to the inductor L1 and the cathode connected to an output terminal of the first drive voltage AVDD1. A capacitor C1 is connected between the cathode of the diode D1 and ground, and a switching element Q1 is connected to a node at which the inductor L1 and the anode of the diode D1 are connected.

In operation, the switching element Q1 is turned on/off in accordance with the signal level of the PWM signal outputted from the AVDD controller 640. When the PWM signal is at a low level, the switching element Q1 is turned off, and the current I1 flowing through the inductor L1 is gradually increased in proportion to the first input voltage Vin1 being applied to the inductor L1 in accordance with the current-voltage characteristics of the inductor L1.

When the PWM signal is at a high level, the switching element Q1 is turned on, the current I1 flowing through the inductor L1 flows through the diode D1, and a voltage is charged in the capacitor C1 in accordance with the current-voltage characteristics of the capacitor C1. Accordingly, the first input voltage Vin1 is boosted to a specified voltage, and is outputted as the first drive voltage AVDD1.

As illustrated in FIG. 5, the AVDD controller 640 includes a first resistor R1, a second resistor R2, a comparator cpr1, and a pulse oscillator (pulse OSC). The AVDD controller 640 outputs the PWM signal of which the duty ratio is varied in accordance with the voltage level of a first feedback voltage Vd1.

The first drive voltage AVDD1 is divided by the first resistor R1 and the second resistor R2, and the first feedback voltage Vd1 is inputted to one input terminal of the comparator cpr1. The pulse OSC generates a reference clock signal RCLK having a specified frequency. The comparator cpr1 compares the reference clock signal RCLK generated from the pulse OSC with the first feedback voltage Vd1, and generates the PWM signal in a manner that, when the level of the first feedback voltage Vd1 is higher than the level of the reference clock signal RCLK, it outputs a high level signal, whereas if the level of the first feedback voltage Vd1 is lower than the level of the reference clock signal RCLK, it outputs a low level signal. In this exemplary embodiment, because the reference clock signal RCLK has a constant frequency, the duty ratio of the PWM signal is changed in accordance with the level of the first feedback voltage Vd1.

Referring to FIG. 4, the second shifter 630 includes an inductor L2 to which the first drive voltage AVDD1 is applied, a diode D2 having the anode connected to the inductor L2 and the cathode connected to an output terminal of the gate-on voltage Von(T), a capacitor C2 connected between the cathode of the diode D2 and ground, a switching element Q2 connected to a node at which the inductor L2 and the anode of the diode D2 are connected, and a second feedback resistor Rd for detecting current flowing through the switching element Q2. The feedback resistor Rd detects the current flowing through the switching element Q2, and provides a third feedback voltage Vd3 to the gate-on voltage controller 650.

In operation, the switching element Q2 is turned on/off in accordance with the signal level of the output signal of the gate-on voltage controller 650 from a Q2 driver 660. If the output signal of the gate-on voltage controller 650 is at a low level, the switching element Q2 is turned off, and the current I2 flowing through the inductor L2 is gradually increased in proportion to the first drive voltage AVDD1 being applied to both ends of the inductor L2 in accordance with the current-voltage characteristics of the inductor L2.

When the output signal of the gate-on voltage controller 650 from the Q2 driver 660 is at a high level, the switching element Q2 is turned on, the current I2 flowing through the inductor L2 flows through the diode D2, and a voltage is charged in the capacitor C2 in accordance with the current-voltage characteristics of the capacitor C2. Accordingly, the first drive voltage AVDD1 is boosted to a specified voltage and is outputted as the gate-on voltage Von(T).

As illustrated in FIG. 4, the gate-on voltage controller 650 also includes a third resistor R3, a fourth resistor R4, a comparator cpr2, a reference voltage generator 680, and a switch driver 660.

In operation, the gate-on voltage Von(T) is divided by the third resistor R3 and the fourth resistor R4, and the second feedback voltage Vd2 is inputted to one input terminal of the comparator cpr2. The reference voltage generator 680 outputs a reference voltage Vref(T) of which the voltage value changes in accordance with the temperature. The comparator cpr2 compares the reference voltage Vref(T) generated from the reference voltage generator 680 with the second feedback voltage Vd2, and when the level of the second feedback voltage Vd2 is higher than the level of the reference voltage Vref(T), it outputs a high level signal, whereas if the level of the second feedback voltage Vd2 is lower than the level of the reference voltage Vref(T), it outputs a low level signal.

As illustrated in FIG. 6, the switch driver 660 includes a third comparator cpr3, an SR flip-flop 670, and a pulse OSC. An output of the comparator cpr3 is inputted to a reset terminal R of the SR flip-flop 670, and the reference clock signal RCLK generated from the pulse OSC is inputted to a set terminal S of the SR flip-flop 670. An output terminal Q of the SR flip-flop 670 is connected to the switching element Q2.

The switch driver 660 adjusts the peak value of the current flowing through the switching transistor Q2 through comparison of the voltage level of the third feedback voltage Vd3 with the output of the second comparator cpr2.

In operation, if the output of the third comparator cpr3 is at a high level, that is, if a high level signal is inputted to the reset terminal R, the SR flip-flop 670 outputs a low level signal through its output terminal Q. At this time, the switching element Q2 is turned off. When the output of the third comparator cpr3 is at a low level, that is, when a low level signal is inputted to the reset terminal R, and a clock signal of a high level is inputted to the set terminal S, the SR flip-flop 670 outputs a high level signal through its output terminal Q. At this time, the switching element Q2 is turned on.

Figure 7:
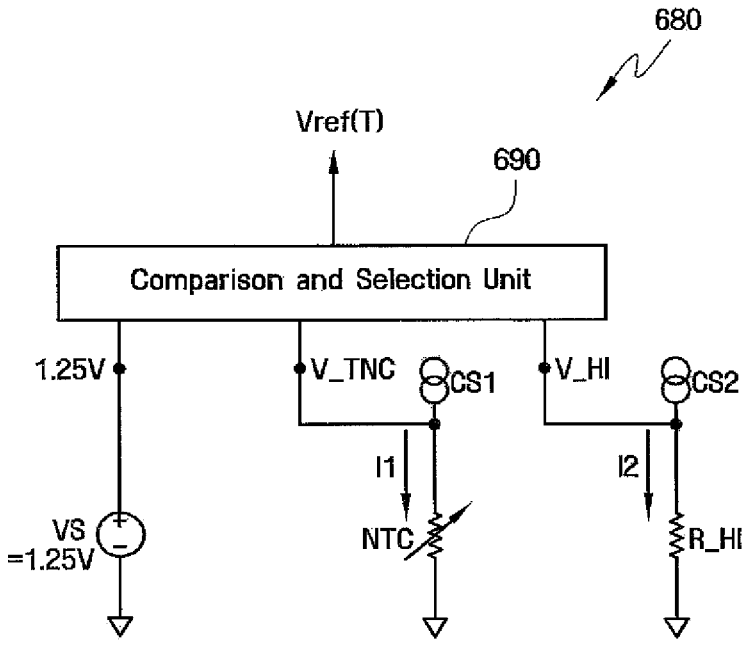
FIG. 7 is a circuit diagram illustrating the configuration of a reference voltage generator of FIG. 4.
Figure 8A:
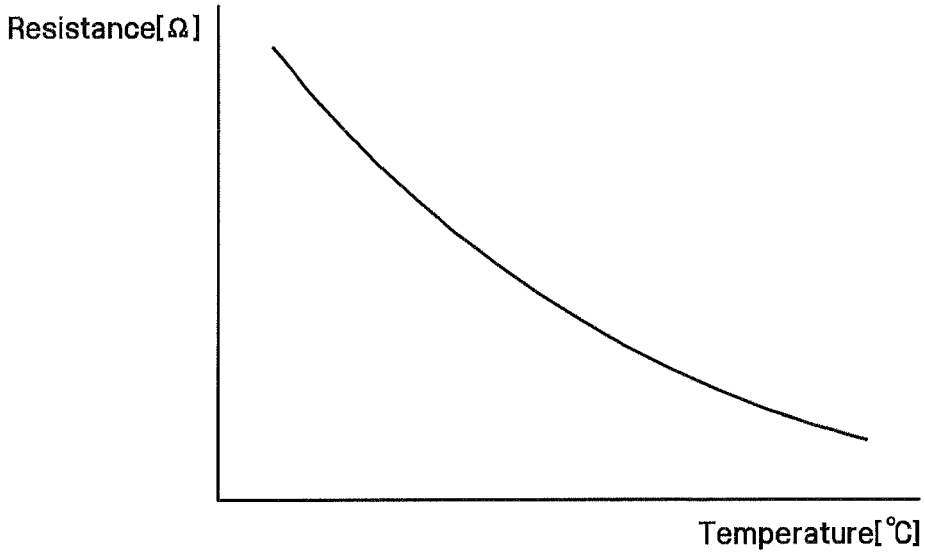
FIG. 8A is a graph explaining the characteristic of a variable element of FIG. 7.
Figure 8B:
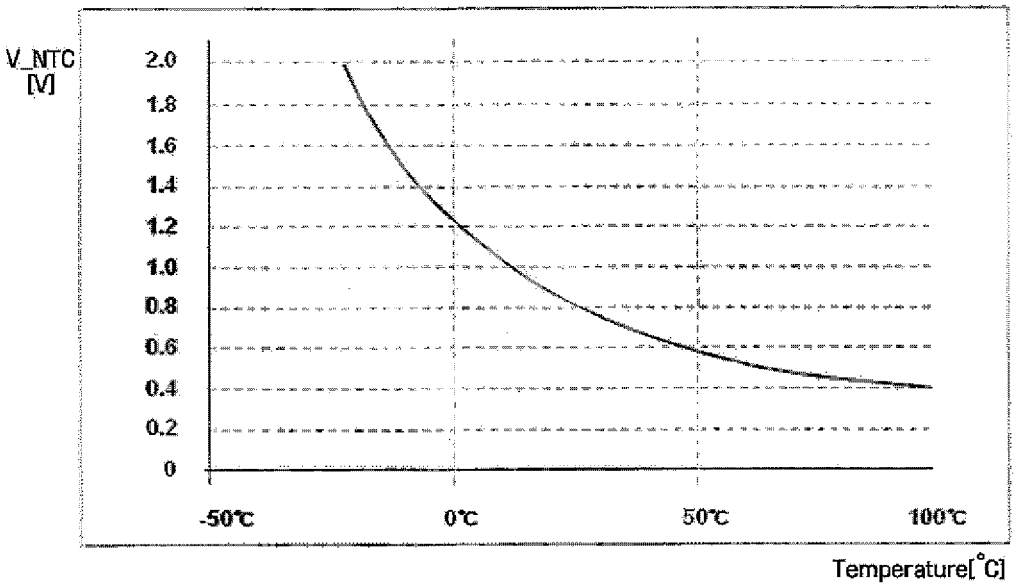
FIG. 8B is a graph explaining a variable voltage of FIG. 7.

FIG. 7 is a circuit diagram illustrating the configuration of the reference voltage generator 680 of FIG. 4. FIG. 8A is a graph explaining the characteristic of a variable element of FIG. 7, and FIG. 5B is a graph explaining a variable voltage of FIG. 7.

Referring to FIG. 7, the reference voltage generator 680 includes a first constant current source CS1 providing a constant current I1 to a variable element NTC, a resistor R_HI outputting a first DC voltage V_HI, a second constant current source CS2 providing a constant current I2 to the resistor R_HI, and a constant voltage source VS outputting a second DC voltage. The so-called variable element can be a negative temperature coefficient (NTC) thermistor having a resistance that decreases as the temperature increases. In this exemplary embodiment, a variable voltage V_NTC has a voltage level that varies in accordance with the voltage value of the variable element NTC, and the second DC voltage has a voltage level that is smaller than the first DC voltage V_HI. Hereinafter, it is assumed that the constant voltage source VS outputs 1.25V as the second DC voltage, and the resistor R_HI and the first constant current source CS1 are set to output the first DC voltage V_HI of 1.8V.

The reference voltage generator 680 includes a comparison and selection unit 690 that receives the first DC voltage V_HI, the variable voltage V_NTC, and the second DC voltage, and selects and outputs one of the three input voltages as the reference voltage Vref(T).

The comparison and selection unit 690 outputs one of the first DC voltage V_HI, the variable voltage V_NTC, and the second DC voltage as the reference voltage Vref(T) in accordance with the result of comparing the voltage level of the variable voltage V_NTC with the voltage level of the first DC voltage V_HI or the voltage level of the second DC voltage. This feature will be described in more detail with reference to FIG. 9.

The variable element NTC may be an NTC resistor element. The resistance value of the NTC resistor element is substantially in inverse proportion to the change of the surrounding temperature. For example, as illustrated in FIG. 8A, as the surrounding temperature rises, the resistance value of the NTC resistor element becomes smaller, while as the surrounding temperature falls, the resistance value of the NTC resistor element becomes larger.

As the resistance value of the variable element NTC is changed as illustrated in FIG. 8A, the variable voltage V_NC varies substantially in inverse proportion to the change of the surrounding temperature, as illustrated in FIG. 5B.

Figure 9:
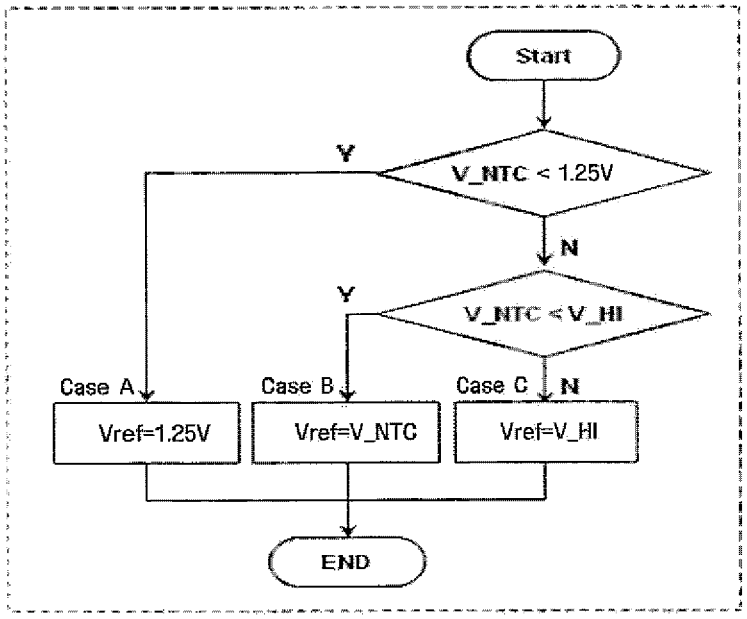
FIG. 9 is a flowchart explaining the operation of a comparison and selection unit of FIG. 7.
Figure 10:
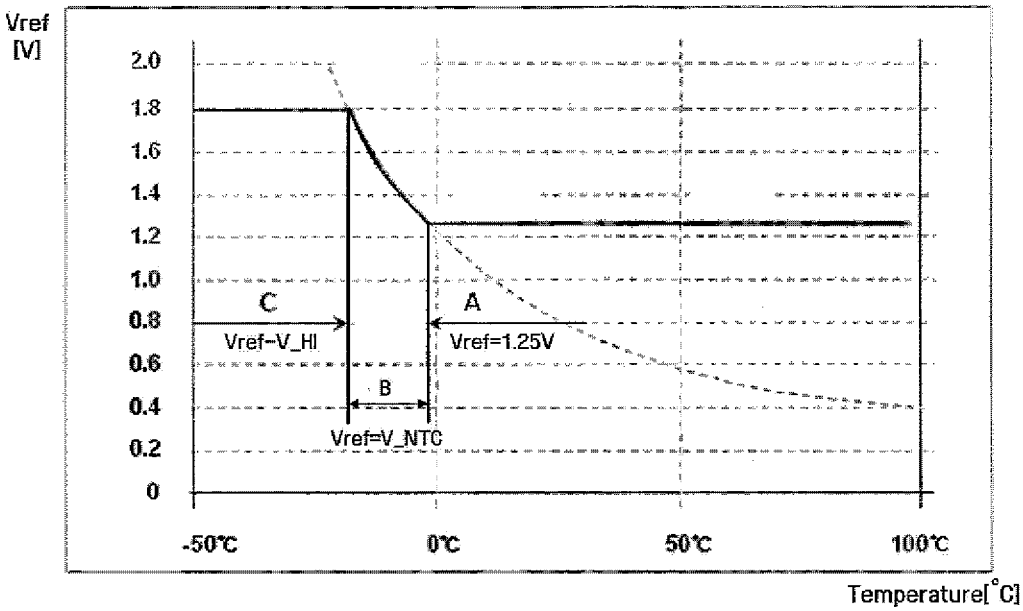
FIG. 10 is a graph explaining a reference voltage of FIG. 7.

FIG. 9 is a flowchart explaining the operation of the comparison and selection unit 690 of FIG. 7, and FIG. 10 is a graph explaining the reference voltage Vref(T) of FIG. 7. As described above, it is assumed that the second DC voltage is 1.25V, and the first DC voltage V_HI is 1.8V.

Referring to FIG. 9, the comparison and selection unit 690 compares the voltage level of the variable voltage V_NTC with the voltage level of the second DC voltage that is 1.25V. If 1.25V is higher than the voltage level of the variable voltage V_NTC that is, case A, the comparison and selection unit 690 selects the second DC voltage, that is, 1.25V, as the reference voltage Vref. If 1.25V is lower than the voltage level of the variable voltage V_NTC, the comparison and selection unit 690 compares the voltage level of the variable voltage V_NTC with the voltage level of the first DC voltage, that is, 1.8V. If 1.8V is higher than the voltage level of the variable voltage V_NTC, that is, case B, the comparison and selection unit 690 selects the variable voltage V_NC as the reference voltage Vref. If the voltage level of the variable voltage V_NTC is higher than 1.8V, the comparison and selection unit 690 selects the voltage level of the first DC voltage, that is, 1.8V, as the reference voltage Vref.

As described above, through the above-described operation of the comparison and selection unit 690, the reference voltage Vref(T) as illustrated in FIG. 10 is outputted. Referring to FIG. 10, as the surrounding temperature is lowered, the comparison and selection unit 690 can confirm that the second DC voltage of 1.25V, the variable voltage V_NTC, and the first DC voltage V_HI (1.8V) have been selected in order.

In other words, the reference voltage Vref(T) has the voltage level of the second DC voltage (1.25V) in a first region A where the surrounding temperature is high, and has the voltage level of the first DC voltage V_HI (1.8V) in a second region C where the surrounding temperature is low. In a third region B between the first region A and the second region C, the reference voltage Vref(T) has the voltage level that smoothly increases from the voltage level of the second DC voltage (1.25V) to the voltage level of the first DC voltage V_HI (1.8V) in accordance with the temperature decrease.

FIG. 10 is a graph explaining the different values of the reference voltage of FIG. 7 at various temperatures.

Figure 11:
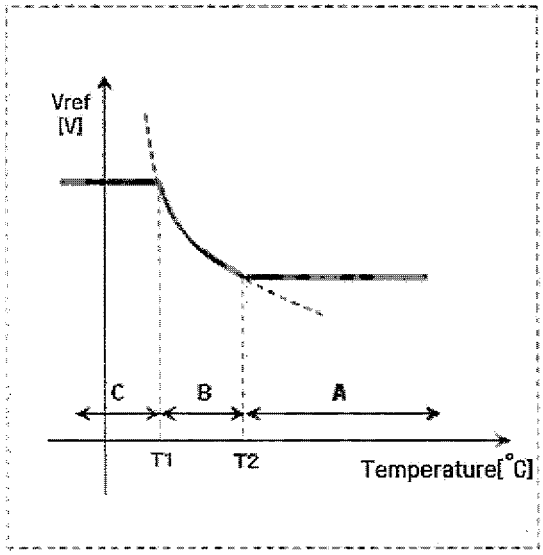
FIG. 11 is a graph explaining a gate-on voltage of FIG. 4.

In summary, with reference to FIGS. 4 to 10, the gate-on voltage controller 610 of FIG. 4 includes the reference voltage generator 680 that is provided with the variable element NTC and outputs the reference voltage V_ref that varies in accordance with the surrounding temperature, as shown in FIG. 7 and FIG. 10. The gate-on voltage controller 610 adjusts the gate-on voltage level Von(T) corresponding to the result of comparing the second feedback voltage Vd2 that corresponds to the gate-on voltage level Von(T) with the reference voltage V_ref as shown in FIG. 4. The gate-on voltage level Von(T) is outputted substantially in proportion to the change of the voltage level of the reference voltage V_ref. Accordingly, the gate-on voltage Von(T) has the voltage level as shown in FIG. 11.

The reference voltage Vref(T) has the first voltage level in the first region A where the surrounding temperature is high, the second voltage level that is higher than the first voltage level in the second region C where the surrounding temperature is low, and the voltage level that smoothly increases from the first voltage level to the second voltage level in accordance with the temperature decrease in the third region B between the first region A and the second region C. That is, the voltage level of the gate-on voltage Von(T) is substantially in reverse proportion to the change of the surrounding temperature.

As described above, the gate-on voltage generator included in the liquid crystal display according to an exemplary embodiment of the present invention outputs the gate-on voltage Von(T) by converting the first input voltage Vin1, and also performs a function of adjusting the voltage level of the gate-on voltage Von(T) in accordance with the surrounding temperature, that is, a temperature compensation function. Thus, the gate-on voltage generator comprises a DC-to-DC converter having a built-in temperature compensation function. Accordingly, the cost required to separately perform the temperature compensation function and the DC-to-DC converting function can be saved thereby to reduce the manufacturing cost.

Figure 12:
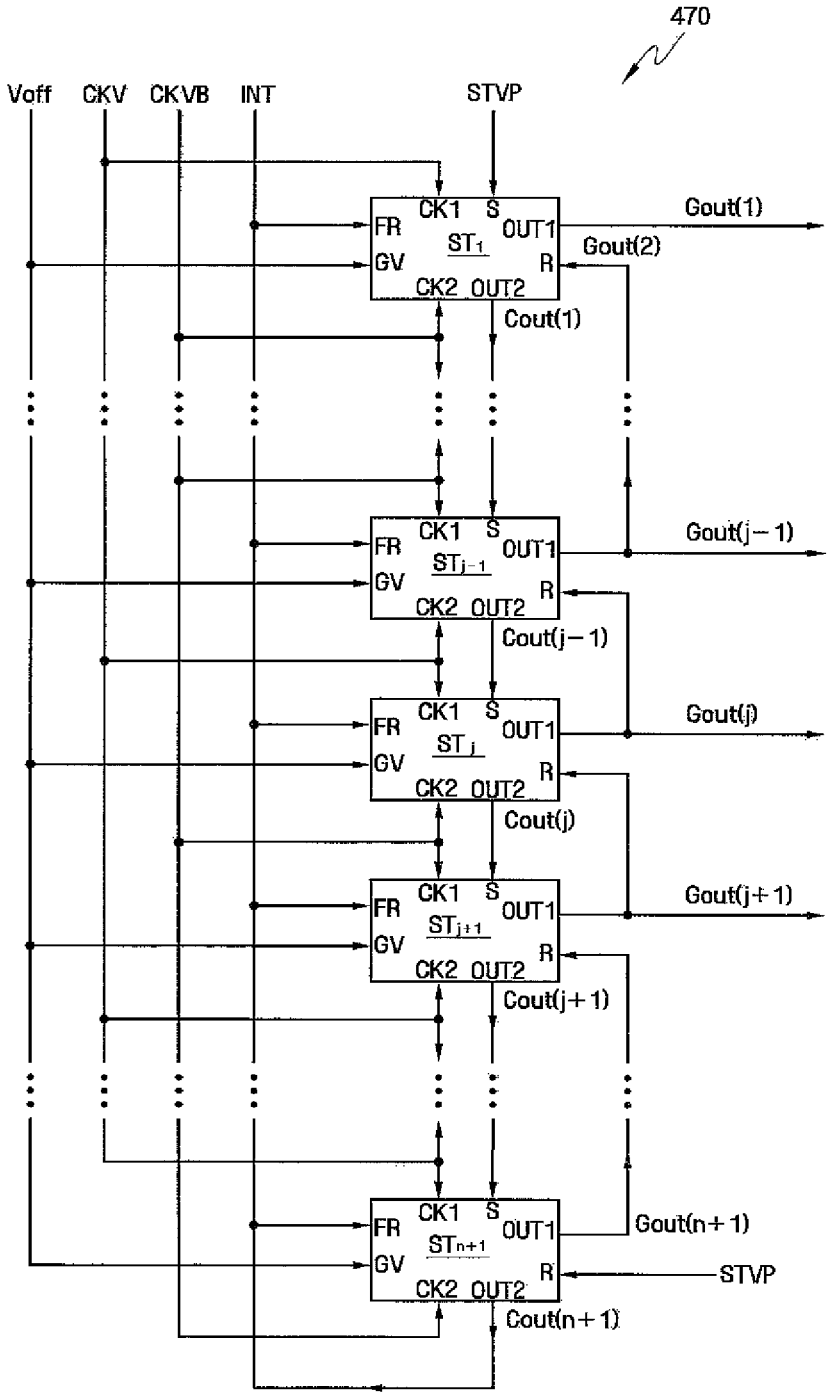
FIG. 12 is an exemplary block diagram illustrating the configuration of a gate driver of FIG. 1.
Figure 13:
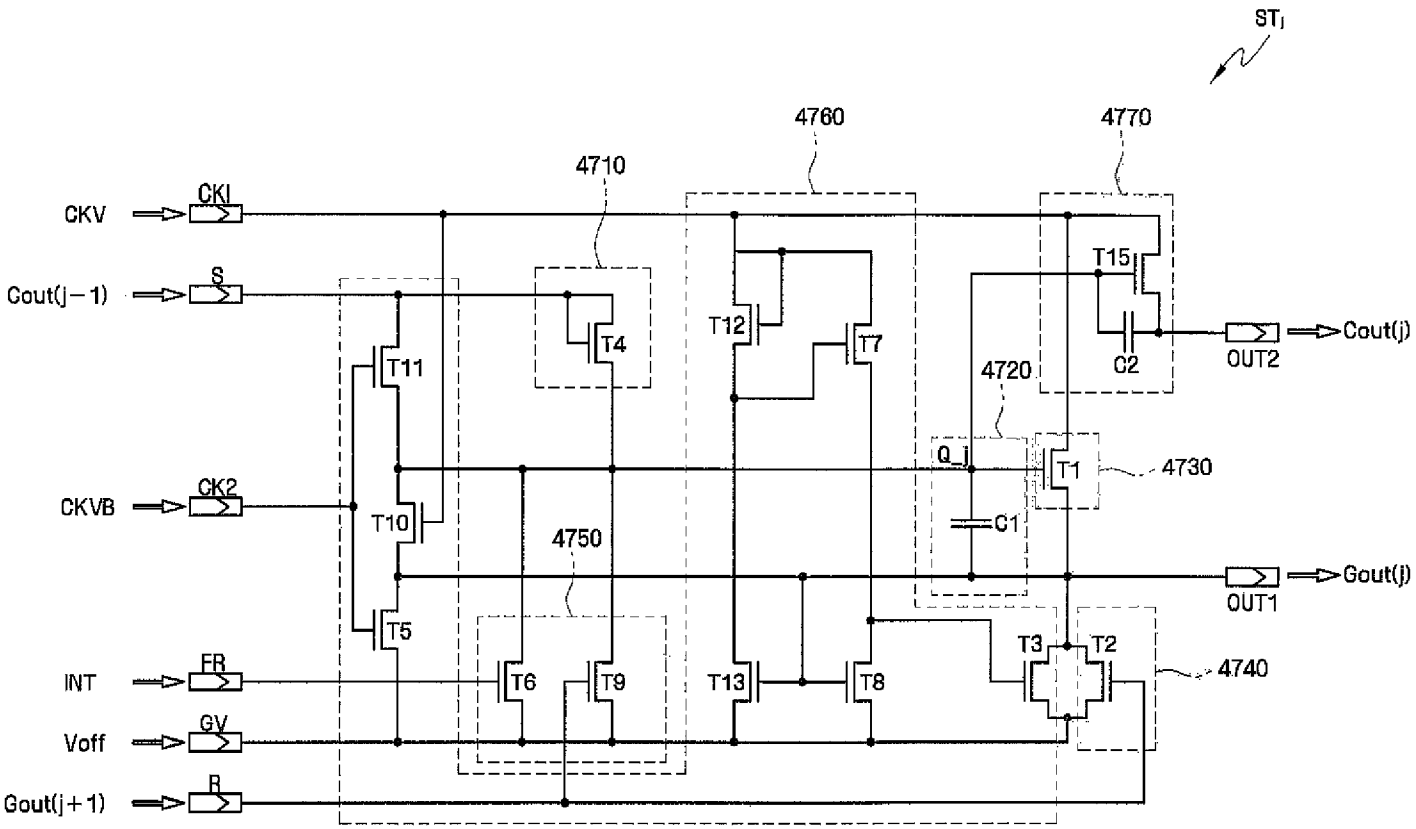
FIG. 13 is an exemplary circuit diagram illustrating the configuration of a j-th stage of FIG. 12.
Figure 14:
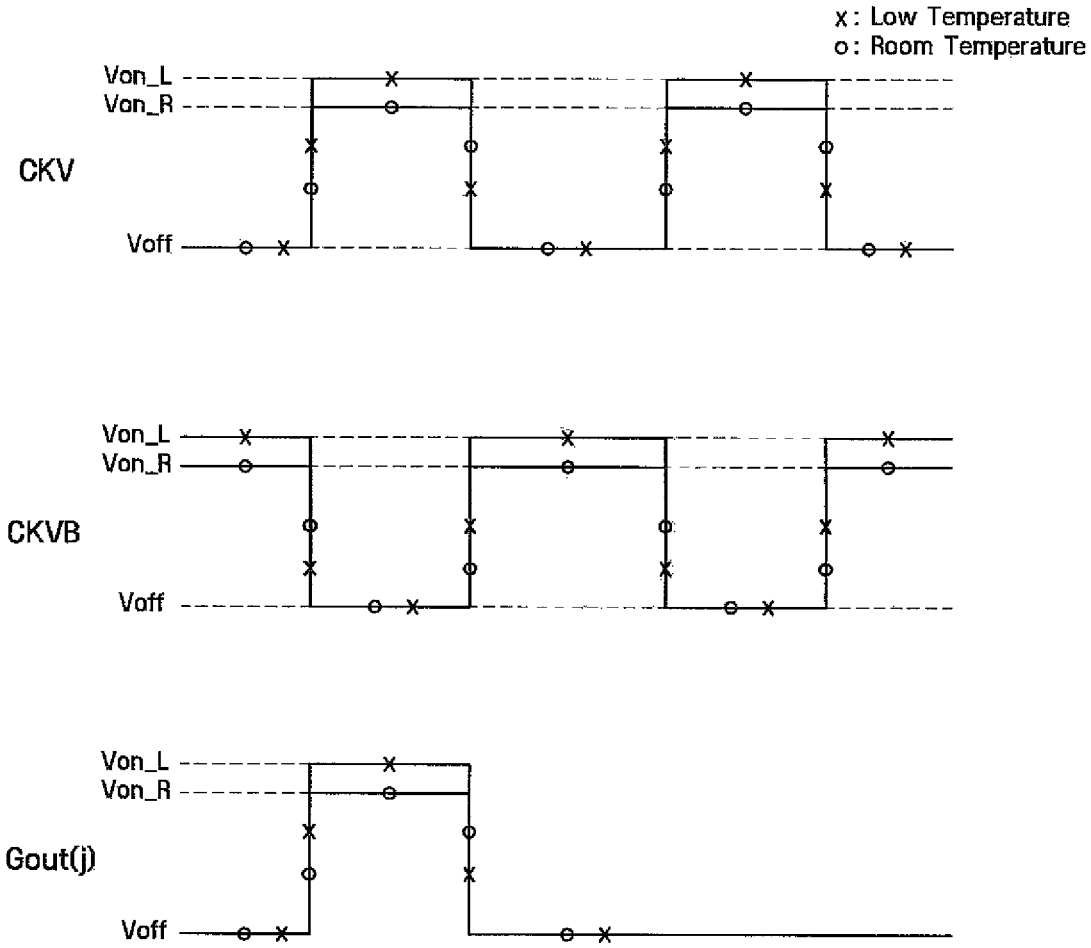
FIG. 14 is a timing diagram illustrating signals inputted to and outputted from a gate driver.

With reference to FIGS. 12 to 14, the gate driver 470 of FIG. 1 will be described in detail. FIG. 12 is an exemplary block diagram illustrating the configuration of the gate driver 470 of FIG. 1, FIG. 13 is an exemplary circuit diagram illustrating the configuration of a j-th stage of the gate driver 470 of FIG. 12, and FIG. 14 is a timing diagram illustrating signals inputted to and outputted from a gate driver.

The gate driver 470, which is enabled by the scan start signal STVP from the clock generator 460 of FIG. 1, generates a plurality of gate signals by using the clock signal CKV, the clock bar signal CKVB, and the gate-off voltage Voff from the clock generator 460 of FIG. 1, and successively provides the gate signals to the gate lines G1 to Gn. The details of the gate driver 470 will now be described in more detail with reference to FIGS. 12 to 14.

Referring to FIG. 12, the gate driver 470 includes a plurality of stages $ST_1$ to $ST_{n+1}$ which are connected in a cascade manner. The respective stages $ST_1$ to $ST_{n+1}$, except for the last stage $ST_{n+1}$, are connected to the gate lines G1 to Gn in a one-to-one manner, and output gate signals $Gout_1$ to $Gout_{(n)}$, respectively. To the respective stages $ST_1$ to $ST_{n+1}$, the gate-off voltage Voff, the clock signal CKV, the clock bar signal CKVB, and an initialization signal INT are inputted. In the exemplary embodiment, although not shown in FIG. 1, the initialization signal INT is provided from the clock generator 460.

Each of the stages $ST_1$ to $ST_{n+1}$ has a first clock terminal CK1, a second clock terminal CK2, a set terminal S, a reset terminal R, a supply voltage terminal GV, a frame reset terminal FR, a gate output terminal OUT1, and a carry output terminal OUT2.

For example, to the set terminal S of the j-th ($j \neq 1$) stage $ST_j$ connected to the j-th gate line, the carry signal $Cout_{(j-1)}$ of the front-end stage $ST_{j-1}$ is inputted, and to the reset terminal R thereof, the gate signal $Gout_{(j+1)}$ of the rear-end stage $ST_{j+1}$ is inputted. To the first clock terminal CK1 and the second clock terminal CK2, the clock signal CKV and the clock bar signal CKVB are inputted, respectively, and to the supply voltage terminal GV, the gate-off voltage Voff is inputted. To the frame reset terminal FR, the initialization signal INT or the carry signal $Cout_{(n+1)}$ of the last stage $ST_{n+1}$ is inputted. The gate output terminal OUT1 outputs the gate signal $Gout_{(j)}$, and the carry output terminal OUT2 outputs the carry signal $Cout_{(j)}$.

To the first stage $ST_1$, the first scan start signal STVP, instead of the front-end carry signal, is inputted, and to the last stage $ST_{n+1}$, the scan start signal STVP, instead of the rear-end gate signal, is inputted.

In this exemplary embodiment, with reference to FIG. 13, the j-th stage $ST_j$ of FIG. 12 will be described in more detail.

Referring to FIG. 13, the j-th stage $ST_j$ includes a buffer unit 4710, a charging unit 4720, a pull-up unit 4730, a carry signal generator 4770, a pull-down unit 4750, a discharging unit 4760, and a holding unit 4780. To the j-th stage $ST_j$, the front-end carry signal $Cout_{(j-1)}$, the clock signal CKV, and the clock bar signal CKVB are provided.

The buffer unit 4710 includes a diode-connected transistor T4. In operation, the buffer unit 4710 provides the front-end carry signal $Cout_{(j-1)}$ inputted through the set terminal S to the charging unit 4720, the carry signal generator 4770, and the pull-up unit 4730.

The charging unit 4720 is composed of a capacitor C1 having one terminal connected to a source of the transistor T4, the pull-up unit 4730, and the discharging unit 4750, and the other terminal connected to the gate output terminal OUT1.

The pull-up unit 4730 includes a transistor T1. The drain of the transistor T1 is connected to the first clock terminal CK1, the gate thereof is connected to the charging unit 4720, and the source thereof is connected to the gate output terminal OUT1.

The carry signal generator 4770 includes a transistor T15 having a drain connected to the first clock terminal CK1, a source connected to the carry output terminal OUT1, and a gate connected to the buffer unit 4710, and a capacitor C2 connected to the gate and the source of the transistor T15.

The pull-down unit 4740 includes a transistor T2 having a drain connected to a source of the transistor T1 and the other terminal of the capacitor C1, a source connected to the supply voltage terminal GV, and a gate connected to the reset terminal R.

The discharging unit 4750 includes a transistor T9 having a gate connected to the reset terminal R, a drain connected to one terminal of the capacitor C1, and a source connected to the supply voltage terminal GV, and discharging the charging unit 4720 in response to the gate signal $Gout_{(j+1)}$ of the next stage $ST_{j+1}$, and a transistor T6 having a gate connected to the frame reset terminal FR, a drain connected to one terminal of the capacitor C1 of the charging unit 4720, and a source connected to the supply voltage terminal GV, and discharging the charging unit 4720 in response to the initialization signal INT.

The holding unit 4760 includes a plurality of transistors T3, T5, T7, T8, T0, T11, T12, and T13. The holding unit 4760 keeps a high level state if the gate signal $Gout_{(j)}$ goes from a low level to a high level, and after the gate signal $Gout_{(j)}$ goes from a high level to a low level, it keeps the gate signal at a low level for one frame, irrespective of the voltage levels of the clock signal CKV and the clock bar signal CKVB.

Referring to FIG. 14, the clock signal CKV and the clock bar signal CKVB inputted to the gate driver 470 of FIG. 1, and the gate signal $Gout_{(j)}$ outputted from the gate driver 470 will be described in detail. As described above, because the clock signal CKV and the clock bar signal CKVB are varied according to the temperature, the signal amplitudes Von_L to Voff at low temperature may be larger than the signal amplitudes Von_R to Voff at room temperature or higher. Also, in the case of the gate signal $Gout_{(j)}$ made by using the clock signal CKV and the clock bar signal CKVB, the signal amplitudes Von_L to Voff at low temperature is larger than the signal amplitudes Von_R to Voff at room temperature or higher.

Accordingly, a drive margin is secured at low temperature, and thus the driving capability of the gate driver 470 does not deteriorate even at low temperature. Because the driving capability of the gate driver 470 does not deteriorate, the display quality of the liquid crystal display can be improved.

Hereinafter, with reference to FIGS. 15 to 18, a liquid crystal display according to an exemplary embodiment of the present invention will be described. The same drawing reference numerals are used for the same elements as in the above-described exemplary embodiment of the present invention and, for convenience, a duplicate explanation of the same elements as those in the previous exemplary embodiment of the present invention will be omitted.

Figure 15:
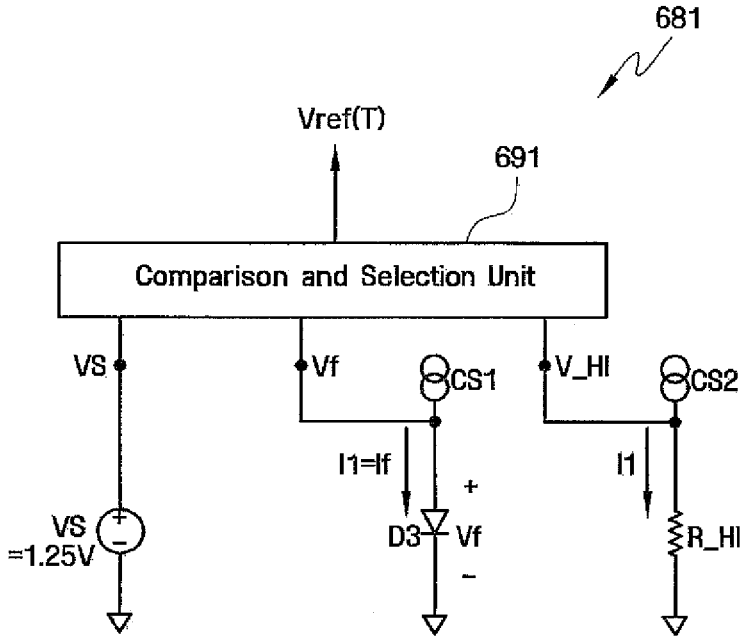
FIG. 15 is a circuit diagram illustrating the configuration of a reference voltage generator included in a liquid crystal display according to an exemplary embodiment of the present invention.
Figure 16:
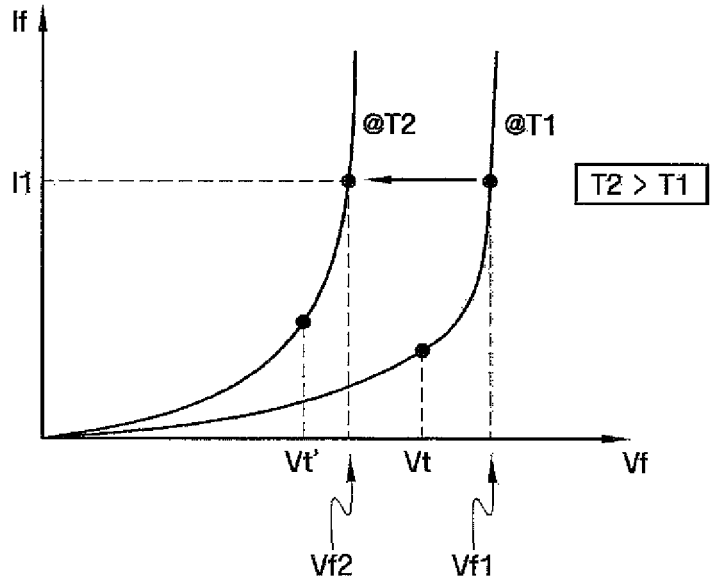
FIG. 16 is a graph explaining the characteristic of a variable element of FIG. 15.

FIG. 15 is a circuit diagram illustrating the configuration of a reference voltage generator included in a liquid crystal display according to an exemplary embodiment of the present invention, and FIG. 16 is a graph explaining the characteristic of a variable element of FIG. 15.

Referring to FIG. 15, an exemplary embodiment of a reference voltage generator 681 that may be used in the liquid crystal display according to the exemplary embodiment of the present invention shown in FIG. 4 includes a first constant current source CS1 providing a constant current I1 to a diode D3, a resistor R_HI forming a first DC voltage V_HI, a second constant current source CS2 providing a constant current I2 to the resistor R_H, and a constant voltage source VS outputting a second DC voltage. In this exemplary embodiment, a variable voltage Vf has a voltage level that varies in accordance with the voltage-current characteristic Vf-If of the diode D3, and the second DC voltage V5 has a voltage level that is smaller than the first DC voltage V_HI. Hereinafter, it is assumed that the constant voltage source VS outputs 1.25V as the second DC voltage V5, and the resistor R_HI and the first constant current source CS1 are set to output the first DC voltage V_HI of 1.8V.

The reference voltage generator 681 shown in FIG. 15 includes a comparison and selection unit 691 that receives as input voltages the first DC voltage V_HI, the variable voltage Vf, and the second DC voltage, and selects and outputs one of the input voltages as the reference voltage Vref(T).

The diode D3 may function as an NTC resistor element as illustrated in FIG. 16. The resistance value of the NTC resistor element is substantially in inverse proportion to the change of the surrounding temperature. For example, as illustrated in FIG. 8A, if the surrounding temperature rises, the resistance value of the NTC resistor element becomes smaller, while if the surrounding temperature falls, the resistance value of the NTC resistor element becomes larger.

The resistance value of the variable element in the form of the diode D3 may have the voltage-current characteristic Vf-If as illustrated in FIG. 16. That is, the diode D3 may have a threshold voltage that is substantially in inverse proportion to the change of the surrounding temperature. Referring to FIG. 16, at a temperature T2 that is higher than a temperature T1, the threshold voltage is increased from Vt to Vt'. At this time, if the first constant current source CS1 provides a constant current I1, the voltage being applied across the terminals of the diode D3 is lowered from Vf1 to Vf2. Accordingly, the variable voltage Vf of FIG. 15 is changed to be substantially in inverse proportion to the change of the surrounding temperature.

Figure 17:
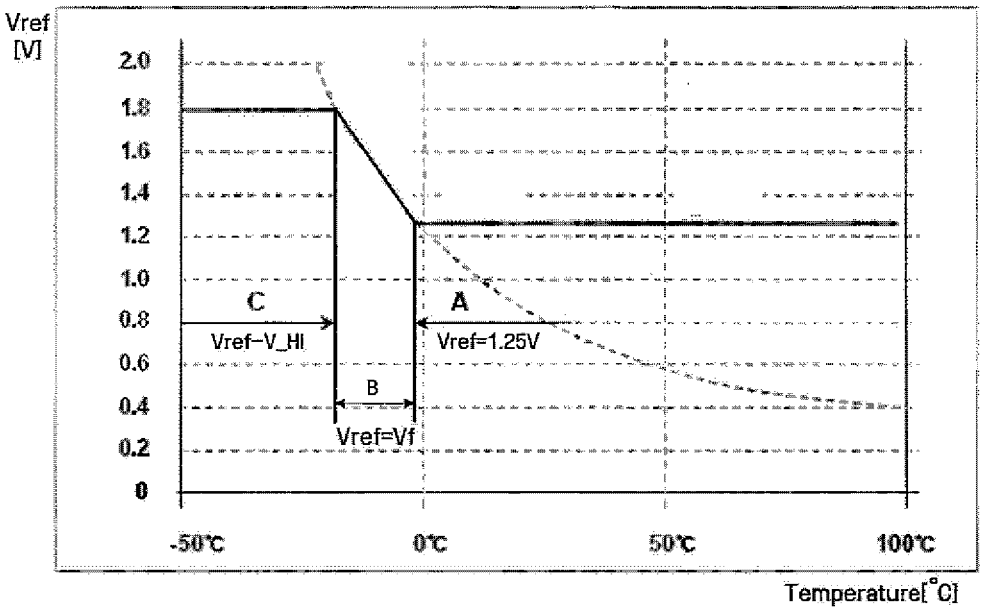
FIG. 17 is a graph explaining a reference voltage of FIG. 16.
Figure 18:
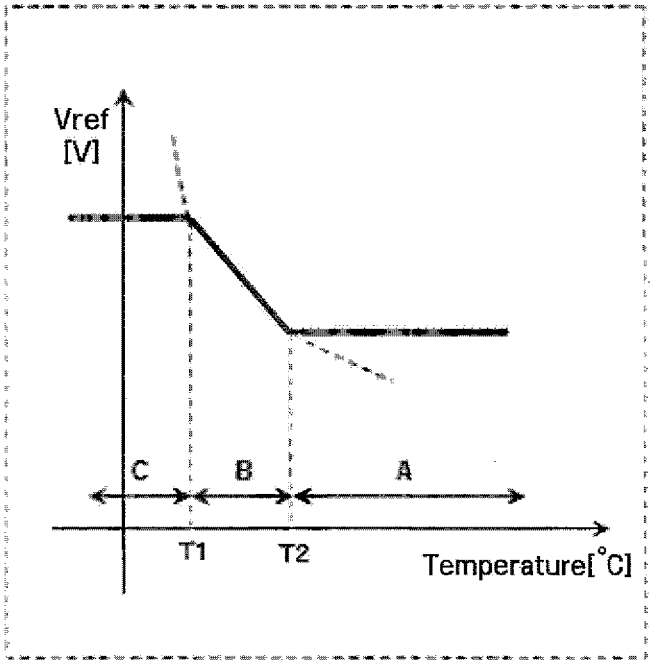
FIG. 18 is a graph explaining a gate-on voltage of FIG. 16.

FIG. 17 is a graph explaining a reference voltage of FIG. 16, and FIG. 18 is a graph explaining a gate-on voltage of FIG. 16.

In FIGS. 15 and 16, if the constant current source CS1 and the diode D3 are properly selected, the reference voltage Vref as illustrated in FIG. 17 can be obtained. That is, unlike the exemplary embodiment of the present invention explained in connection with FIG. 10, the variable voltage Vf can be changed in a straight line in the third region B. In the exemplary embodiment of the present invention shown in FIG. 15, the diode D3, which is used as the variable element, is merely an exemplary element for deriving the change of the reference voltage Vref in a straight line corresponding to the change of the surrounding temperature, and thus it is apparent that the present invention is not limited thereto.

The gate-on voltage generator included in the liquid crystal display according to the above-described exemplary embodiment of the present invention outputs the gate-on voltage Von(T) by converting the first input voltage Vin1, and also performs a function of adjusting the voltage level of the gate-on voltage Von(T) in accordance with the surrounding temperature, that is, it performs a temperature compensation function. Accordingly, the manufacturing cost can be reduced in the same manner as the initially described exemplary embodiment of the present invention. Also, because the driving capability of the gate driver 470 does not deteriorate even at low temperatures, the display quality of the liquid crystal display can be improved.

Hereinafter, with reference to FIGS. 19 to 21, the liquid crystal display according to an exemplary embodiment of the present invention will be described. The same drawing reference numerals are used for the same elements as in the initially described exemplary embodiment of the present invention, and, for convenience, a duplicate explanation of the same elements as those in the initially described exemplary embodiment of the present invention will be omitted.

Figure 19:
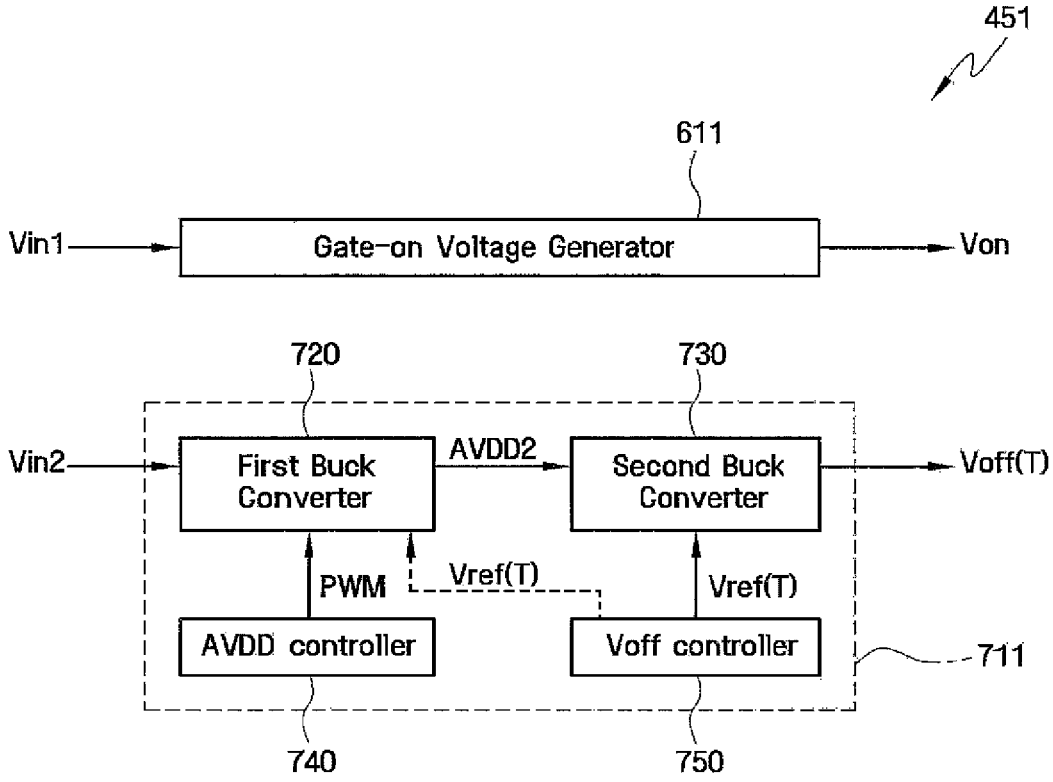
FIG. 19 is a block diagram illustrating the configuration of a gate voltage generator included in a liquid crystal display according to an exemplary embodiment of the present invention.
Figure 20A:
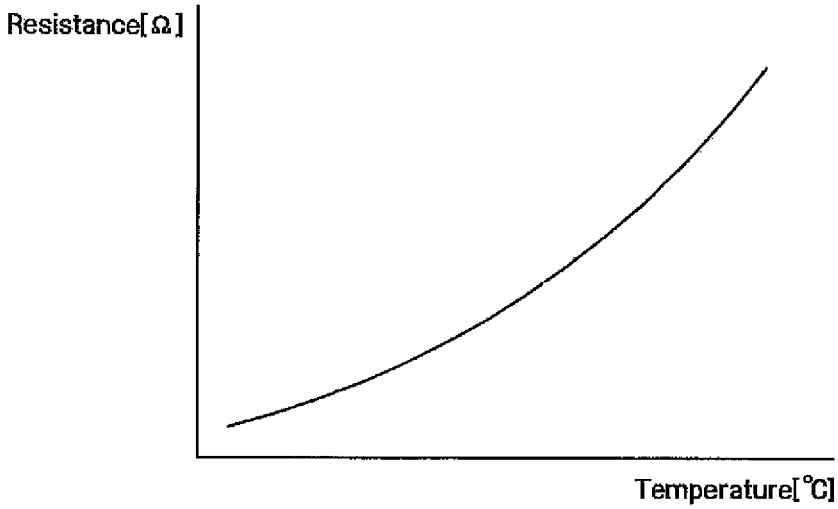
FIGS. 20A, 20B, and 20C are graphs explaining the characteristic of a variable element, a reference voltage, and a gate-off voltage in a liquid crystal display according to an exemplary embodiment of the present invention.
Figure 20B:
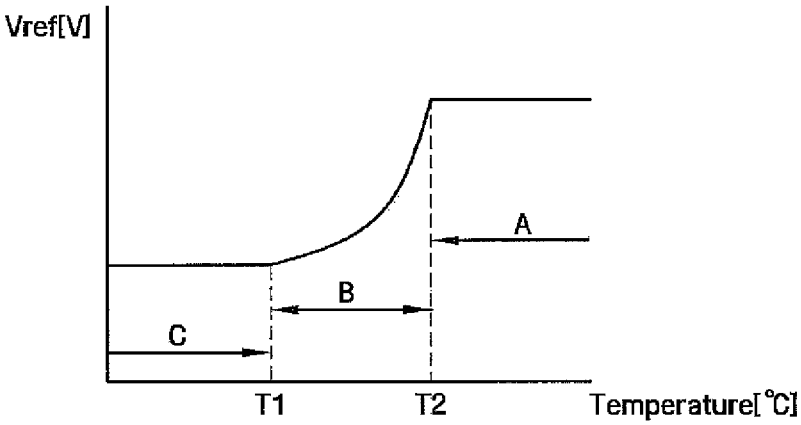

FIG. 20*b* is a graph explaining a reference voltage of FIG. 19, and FIG. 18 is a graph explaining a gate-on voltage of FIG. 19.

Referring to FIG. 19, the gate voltage generator 451 for use in the exemplary embodiment shown in FIG. 1 includes a gate-on voltage generator 611 and a gate-off voltage generator 711. The gate-on voltage generator 611 receives a first input voltage Vin1, and outputs a gate-on voltage Von. The gate-off voltage generator 711 receives a second input voltage Vin2, and outputs a gate-off voltage Voff(T). In this exemplary embodiment, the first input voltage Vin1 and the second input voltage Vin2 may be the same voltage Vin. Also, the reason why the gate-off voltage is indicated by Voff(T) is that the voltage level of the gate-off voltage may be varied in accordance with the surrounding temperature.

The gate-off voltage generator 711 includes a first reduction shifter or buck converter 720, a second reduction shifter or buck converter 730, and a gate-off voltage controller 750.

The first reduction shifter or buck converter 720 receives the second input voltage Vin2, and outputs a first drive voltage AVDD2 obtained by reduction-shifting the voltage level of the second input voltage Vin2. The second reduction shifter or buck converter 730 outputs the gate-off voltage Voff(T) obtained by reduction-shifting the voltage level of the first drive voltage AVDD2. The first reduction shifter 720 and the second reduction shifter 730 may be as noted, for example, buck converters. A buck converter is an example of a DC-to-DC converter, and the first reduction shifter 720 and the second reduction shifter 730 may be converters different from each other.

The gate-off voltage controller 750 includes a variable element having a resistance value that is varied in accordance with the surrounding temperature, and adjusts a reduction amount of the first reduction shifter 720 as shown by the broken arrow Vref(T) from the gate-off voltage controller 750 to the first reduction shifter 720 in FIG. 19 or a reduction amount of the second reduction shifter 730. The gate-off voltage controller 750 adjusts the reduction amount of the first reduction shifter 720 or the reduction amount of the second reduction shifter 730 by outputting a reference voltage Vref(T) of which the voltage level is changed in accordance with the surrounding temperature. FIG. 19 shows that the gate-off voltage controller 750 adjusts the reduction amount of the second reduction shifter 730. Although it is exemplified that, for convenience in explanation, the gate-off voltage controller 750 adjusts the reduction amount of the second reduction shifter 730 as shown in FIG. 19, it will be apparent that the present invention is not limited thereto.

The gate-off voltage generator 711 may further include a first drive voltage controller 740. As described above, in the case where the gate-off voltage controller 750 adjusts the reduction amount of the second reduction shifter or buck converter 730, the first drive voltage controller 740 controls the first reduction shifter or buck converter 720 to perform reduction-shifting of the voltage level of the second input voltage Vin2 to the first drive voltage AVDD2 by outputting a PWM signal to the first reduction shifter or buck converter 720.

The gate-off voltage controller 750 may include a reference voltage generator (not illustrated) having a variable element so as to output the reference voltage Vref(T) that is varied in accordance with the surrounding temperature, and to adjust the gate-off voltage level Voff(T) corresponding to the result of comparing the first feedback voltage, see FIG. 4, that corresponds to the gate-off voltage level Voff(T). The reference voltage generator (not illustrated) included in the gate-off voltage controller 750 may include a comparison and selection unit (not illustrated). The comparison and selection unit receives the first DC voltage, the variable voltage having a voltage level that is changed in accordance with the resistance value of the variable element, and the second DC voltage that is lower than the first DC voltage, compares the voltage level of the variable voltage with the voltage level of the first DC voltage or the voltage level of the second DC voltage, and selects and outputs one of the first DC voltage, the variable voltage, and the second DC voltage. The gate-off voltage generator 711 may be implemented in the same manner as the gate-on voltage generator according to the initially described exemplary embodiment of the present invention, and the detailed description thereof will be omitted for convenience.

Figure 20C:
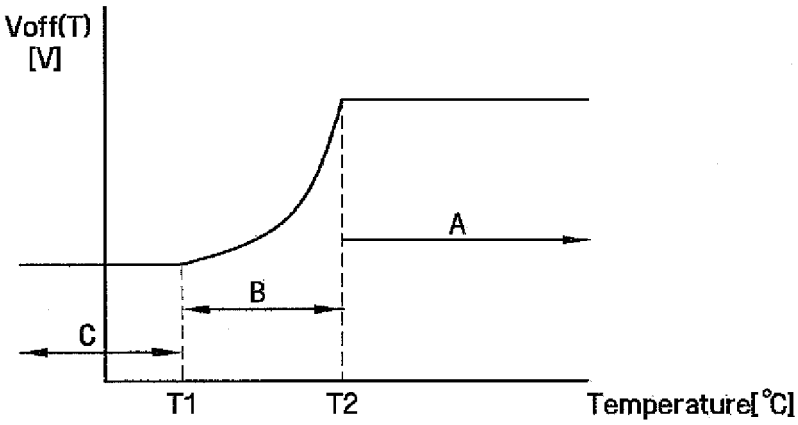

FIGS. 20*a*, 20*b*, and 20*c* are graphs explaining the characteristic of a variable element, a reference voltage, and a gate-off voltage in a liquid crystal display according to an exemplary embodiment of the present invention.

The gate-off voltage controller (See 750 in FIG. 19) may include a variable element the resistance value of which is varied in accordance with the surrounding temperature. The resistance value of the variable element, as shown in FIG. 20*a*, may be substantially in direct proportion to the change of the surrounding temperature.

In the case where the resistance value of the variable element is changed as shown in FIG. 20*a*, the reference voltage Vref(T) may be changed as illustrated in FIG. 20*b*. The reference voltage Vref(T) has the voltage level of the first DC voltage in the first region A where the surrounding temperature is high, the voltage level of the second DC voltage that is lower than the first voltage level in the second region C where the surrounding temperature is relatively low, and the voltage level that continuously and smoothly decreases from the voltage level of the first DC voltage to the voltage level of the second DC voltage in accordance with the temperature decrease in the third region B between the first region A and the second region C.

As the reference voltage level Vref(T) is changed as illustrated in FIG. 20*b*, the gate-off voltage Voff(T) may have the voltage level as illustrated in FIG. 20*c*.

As shown in FIG. 20*c*, the gate-off voltage Voff(T) has the first voltage level in the first region A where the surrounding temperature is high, the second voltage level that is lower than the first voltage level in the second region C where the surrounding temperature is low, and the voltage level that continuously and smoothly decreases from the first voltage level to the second voltage level in accordance with the temperature decrease in the third region B between the first region A and the second region C. That is, the voltage level of the gate-off voltage Voff(T) is substantially in proportion to the change of the surrounding temperature.

The gate-off voltage generator included in the liquid crystal display according to this exemplary embodiment of the present invention outputs the gate-off voltage Voff(T) by converting the second input voltage Vin2, and also performs a function of adjusting the voltage level of the gate-off voltage Voff(T) in accordance with the surrounding temperature, that is, it performs a temperature compensation function. Accordingly, the manufacturing cost can be reduced in the same manner as the initially described exemplary embodiment of the present invention.

Figure 21:
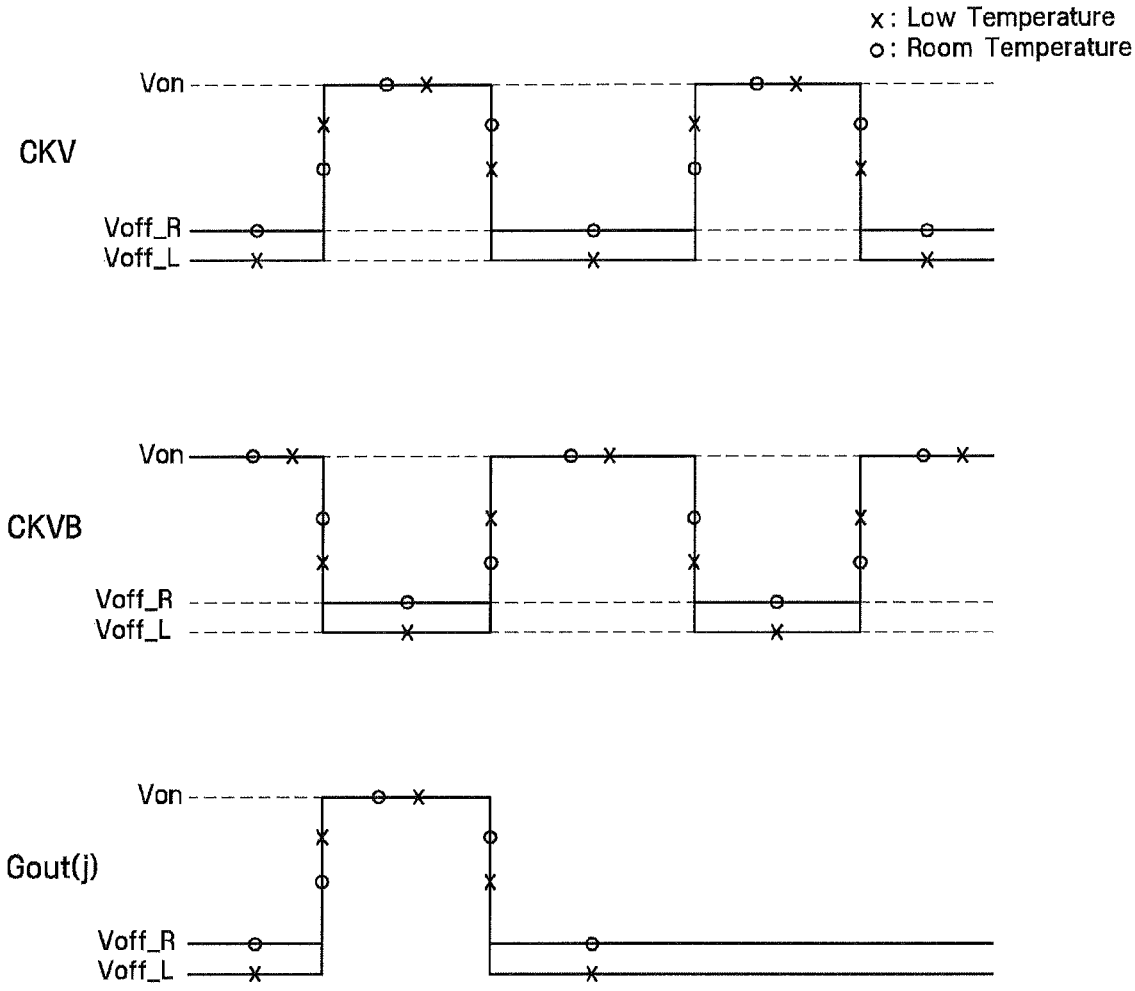
FIG. 21 is a timing diagram illustrating signals inputted to or outputted from a gate driver in a liquid crystal display according to an exemplary embodiment of the present invention.

FIG. 21 is a timing diagram illustrating signals inputted to or outputted from a gate driver, such as 470 in FIG. 1, in a liquid crystal display according to this exemplary embodiment of the present invention.

Referring to FIG. 21, the clock signal CKV and the clock bar signal CKVB inputted to the gate driver 470, and the gate signal $Gout_{(j)}$ outputted from the gate driver 470 will be described in detail. As described above, because the clock signal CKV and the clock bar signal CKVB are varied according to the temperature, the signal amplitudes Von to Voff_L at low temperature are larger than the signal amplitudes Von to Voff_R at room temperature. Also, in the case of the gate signal $Gout_{(j)}$ made by using the clock signal CKB and the clock bar signal CKVB, the signal amplitudes Von to Voff_L at low temperature are larger than the signal amplitudes Von to Voff_R at room temperature.

Accordingly, a drive margin is secured at low temperatures, and thus the driving capability of the gate driver 470 does not deteriorate even at a low temperature. Because the driving capability of the gate driver 470 does not deteriorate, the display quality of the liquid crystal display can be improved.

Hereinafter, with reference to FIGS. 22 and 23, a liquid crystal display according to an exemplary embodiment of the present invention will be described. The same drawing reference numerals are used for the same elements as in the above-described exemplary embodiments of the present invention and, for convenience, a duplicate explanation of the same elements as those in the preceding exemplary embodiments of the present invention will be omitted.

Figure 22:
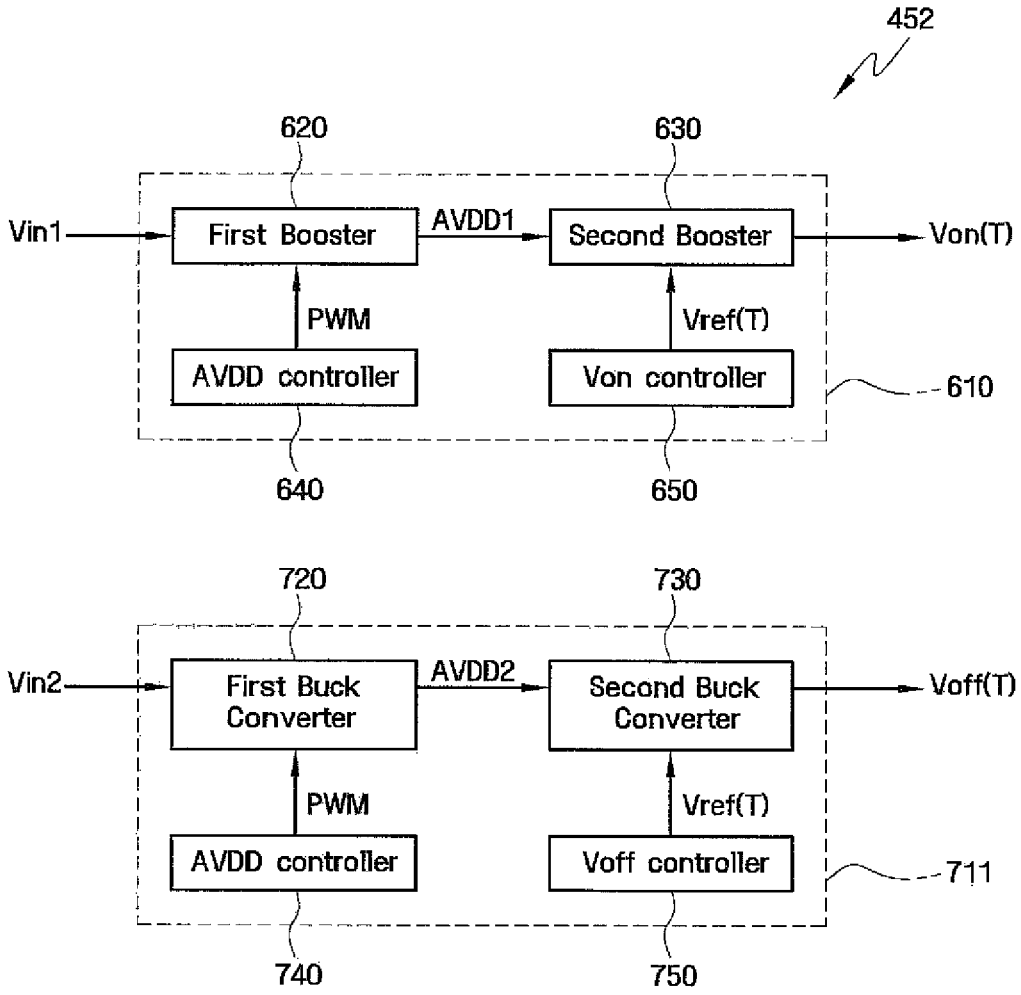
FIG. 22 is a block diagram illustrating the configuration of a gate voltage generator included in a liquid crystal display according to an exemplary embodiment of the present invention.

FIG. 22 is a block diagram illustrating the configuration of a gate voltage generator for use in the exemplary embodiment shown in FIG. 1 included in a liquid crystal display according to an exemplary embodiment of the present invention.

Referring to FIG. 22, the gate voltage generator 452 included in the liquid crystal display according to the exemplary embodiment of the present invention includes a gate-on voltage generator 610 and a gate-off voltage generator 711. The gate-on voltage generator 610 receives a first input voltage Vin1, and outputs a gate-on voltage Von(T). The gate-off voltage generator 711 receives a second input voltage Vin2, and outputs a gate-off voltage Voff. Because the gate-on voltage generator 610 and the gate-off voltage generator 711 have been described in the preceding exemplary embodiments of the present invention, the detailed description thereof will be omitted for convenience.

The gate-on voltage generator 610 included in the liquid crystal display according to this exemplary embodiment of the present invention outputs the gate-on voltage Von(T) by converting the first input voltage Vin1, and also performs a function of adjusting the voltage level of the gate-on voltage Von(T) in accordance with the surrounding temperature, that is, it performs a temperature compensation function. Also, the gate-off voltage generator 711 outputs the gate-off voltage Voff(T) by converting the second input voltage Vin2, and also performs a function of adjusting the voltage level of the gate-off voltage Voff(T) in accordance with the surrounding temperature, that is, it also performs a temperature compensation function.

The gate-on voltage generator 610 and the gate-off voltage generator 711 may be DC-to-DC converters having a built-in temperature compensation function. Accordingly, the cost required to separately perform the temperature compensation function and the DC-to-DC converting function can be saved, thereby to reduce the manufacturing cost.

Figure 23:
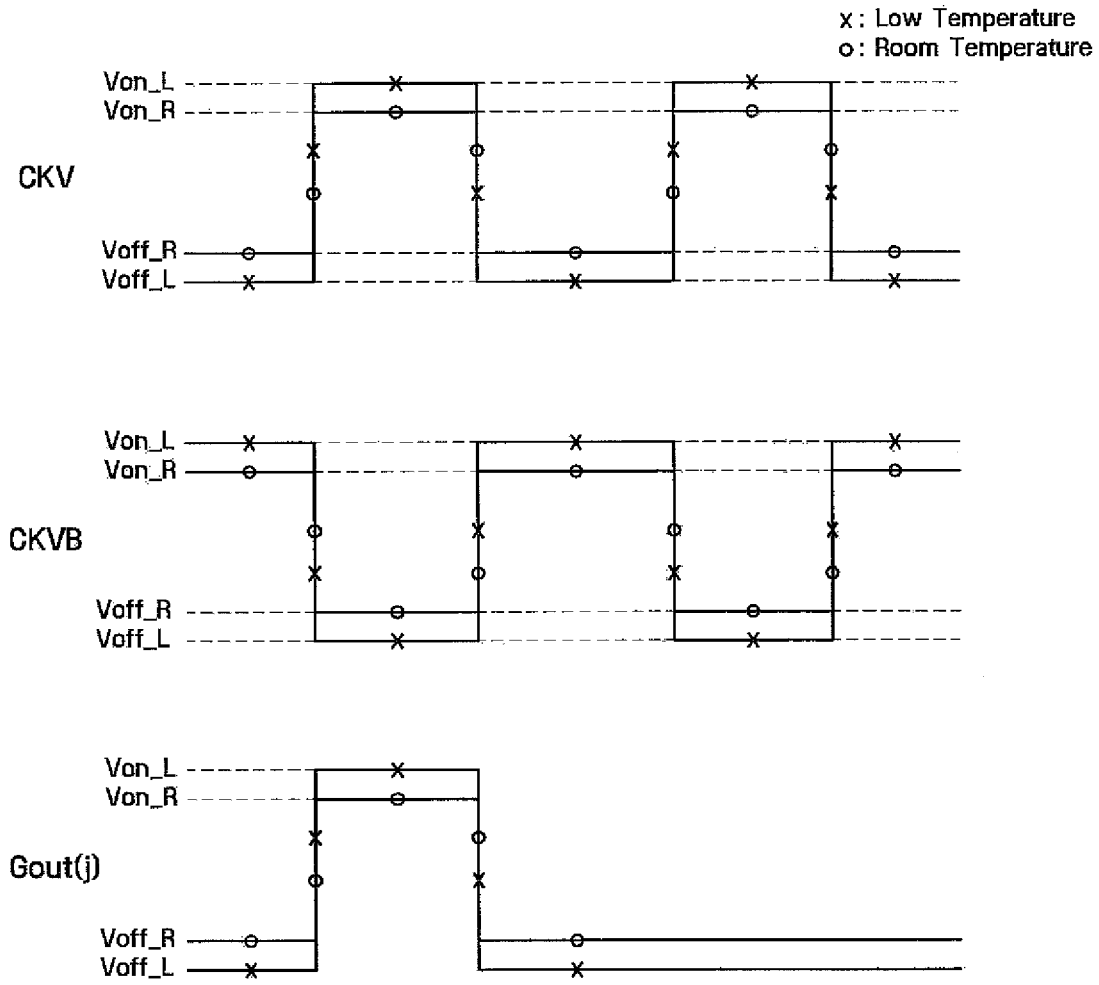
FIG. 23 is a timing diagram illustrating signals inputted to and outputted from a gate driver in a liquid crystal display according to an exemplary embodiment of the present invention.

FIG. 23 is a timing diagram illustrating signals inputted to and outputted from a gate driver in a liquid crystal display according to the above-described exemplary embodiment of the present invention.

Referring to FIG. 23, the clock signal CKV and the clock bar signal CKVB inputted to the gate driver 470, and the gate signal $Gout_{(j)}$ outputted from the gate driver 470 will be described in detail. As described above, because the clock signal CKV and the clock bar signal CKVB are varied according to the temperature, the signal amplitudes Von_L to Voff_L at low temperature are larger than the signal amplitudes Von_R to Voff_R at room temperature. Also, in the case of the gate signal $Gout_{(j)}$ made by using the clock signal CKV and the clock bar signal CKVB, the signal amplitudes Von_L to Voff_L at low temperature are larger than the signal amplitudes Von_R to Voff_R at room temperature.

Accordingly, a drive margin is secured at low temperatures, and thus the driving capability of the gate driver 470 does not deteriorate even at low temperatures. Because the driving capability of the gate driver 470 does not deteriorate, the display quality of the liquid crystal display can be improved.

Although exemplary embodiments of the present invention have been described for illustrative purposes, those of ordinary skill in the art will appreciate that various modifications, additions and substitutions are possible, without departing from the scope and spirit of the invention as disclosed in the accompanying claims.

What is claimed is:

1. A drive voltage generating circuit comprising:

a first shifter receiving an input voltage, first shifting a voltage level of the input voltage, and outputting a first drive voltage;

a second shifter second shifting a voltage level of the first drive voltage and outputting a second drive voltage; and a drive voltage controller adjusting one of a shifting amount of the first shifter and a shifting amount of the second shifter in accordance with a surrounding temperature, wherein the second drive voltage is continuously varied in relation to changes in the surrounding temperature, wherein a voltage level of the second drive voltage is substantially in an inverse proportion to a change of the surrounding temperature, and wherein the second drive voltage has a first voltage level in a first region where the surrounding temperature is high, a second voltage level that is higher than the first voltage level in a second region where the surrounding temperature is low, and a voltage level that continuously increases from the first voltage level to the second voltage level in accordance with the temperature decrease in a third region between the first region and the second region.

2. The drive voltage generating circuit of claim 1, wherein the second drive voltage is a gate-on voltage.

3. The drive voltage generating circuit of claim 1, wherein the first shifter, the second shifter, and the drive voltage controller are formed on a single chip.

4. The drive voltage generating circuit of claim 1, wherein the drive voltage generating circuit is a buck converter or a boost converter.

5. The drive voltage generating circuit of claim 1, wherein the drive voltage controller comprises a reference voltage generator including a variable element and outputting a reference voltage that is varied in accordance with the surrounding temperature, and adjusting the second drive voltage level corresponding to a result of comparing a first feedback voltage that corresponds to the second drive voltage level with the reference voltage.

6. The drive voltage generating circuit of claim 5, wherein the second drive voltage level is substantially in direct proportion to a change of a voltage level of the reference voltage.

7. The drive voltage generating circuit of claim 5, wherein the resistance value of the variable element is substantially in an inverse proportion to a change of the surrounding temperature.

8. The drive voltage generating circuit of claim 5, wherein one of the first shifter and the second shifter comprises a switching element, the drive voltage controller further comprises a comparator comparing the first feedback voltage with the reference voltage, and the drive voltage controller turns on/off the switching element based on a result of comparing a second feedback voltage that is in proportion to a current flowing through the switching element with an output of the comparator.

9. The drive voltage generating circuit of claim 5, wherein the reference voltage generator receives a first DC voltage, a variable voltage having a voltage level that is varied in accordance with the resistance value of the variable element, and a second DC voltage that is lower than the first DC voltage, compares the voltage level of the variable voltage with a voltage level of the first DC voltage or a voltage level of the second DC voltage, and selects and outputs any one of the first DC voltage, the variable voltage, and the second DC voltage as the reference voltage.

10. A drive voltage generating circuit, comprising:

a first shifter receiving an input voltage, first shifting a voltage level of the input voltage, and outputting a first drive voltage;

a second shifter second shifting a voltage level of the first drive voltage and outputting a second drive voltage; and a drive voltage controller adjusting one of a shifting amount of the first shifter and a shifting amount of the second shifter in accordance with a surrounding temperature, wherein the second drive voltage is continuously varied in relation to changes in the surrounding temperature, wherein the drive voltage controller comprises a reference voltage generator including a variable element and outputting a reference voltage that is varied in accordance with the surrounding temperature, and adjusting the second drive voltage level corresponding to a result of comparing a first feedback voltage that corresponds to the second drive voltage level with the reference voltage, and wherein the second drive voltage is a gate-off voltage, and wherein the gate-off voltage has a first voltage level in a first region where the surrounding temperature is high, a second voltage level that is higher than the first voltage level in a second region where the surrounding temperature is low, and a voltage level that continuously decreases from the first voltage level to the second voltage level in accordance with the temperature decrease in a third region between the first region and the second region.

11. A liquid crystal display comprising:

a drive voltage generating circuit including;

a first shifter receiving an input voltage, first shifting a voltage level of the input voltage, and outputting a first drive voltage, a second shifter second shifting a voltage level of the first drive voltage and outputting a second drive voltage, and a drive voltage controller adjusting one of a shifting amount of the first shifter and a shifting amount of the second shifter in accordance with a surrounding temperature, wherein the second drive voltage is continuously varied in relation to changes in the surrounding temperature;

a gate driver outputting a gate signal generated by using the second drive voltage; and a plurality of pixels being turned on/off in accordance with the gate signal from the gate driver, wherein the second drive voltage is a gate-on voltage or a gate-off voltage, and wherein a voltage level of the gate-off voltage is substantially in an inverse proportion to a change of the surrounding temperature, and wherein the voltage level of the gate-off voltage has a first voltage level in a first region where the surrounding temperature is high, a second voltage level that is higher than the first voltage level in a second region where the surrounding temperature is low, and a voltage level that continuously decreases from the first voltage level to the second voltage level in accordance with the temperature decrease in a third region between the first region and the second region.

12. The liquid crystal display of claim 11, wherein a voltage level of the second drive voltage is substantially in an inverse proportion to a change of the surrounding temperature.

13. The liquid crystal display of claim 11, wherein the drive voltage controller comprises a reference voltage generator including a variable element and outputting a reference voltage that is varied in accordance with the surrounding temperature, and adjusting the second drive voltage level corresponding to a result of comparing a first feedback voltage that corresponds to the second drive voltage level with the reference voltage.

14. The liquid crystal display of claim 11, further comprising a clock generator receiving the second drive voltage and outputting a first clock signal and a second clock signal, wherein the gate signal is generated by using the first clock signal and the second clock signal.

15. The liquid crystal display of claim 11, wherein the gate driver generates the gate signal using amorphous silicon thin film transistors.

16. A liquid crystal display, comprising:

a drive voltage generating circuit including;

a first shifter receiving an input voltage, first shifting a voltage level of the input voltage, and outputting a first drive voltage, a second shifter second shifting a voltage level of the first drive voltage and outputting a second drive voltage, and a drive voltage controller adjusting one of a shifting amount of the first shifter and a shifting amount of the second shifter in accordance with a surrounding temperature, wherein the second drive voltage is continuously varied in relation to changes in the surrounding temperature;

a gate driver outputting a gate signal generated by using the second drive voltage; and a plurality of pixels being turned on/off in accordance with the gate signal from the gate driver, wherein the second drive voltage is a gate-on voltage or a gate-off voltage, wherein a voltage level of the second drive voltage is substantially in an inverse proportion to a change of the surrounding temperature, and wherein the second drive voltage has a first voltage level in a first region where the surrounding temperature is high, a second voltage level that is higher than the first voltage level in a second region where the surrounding temperature is low, and a voltage level that continuously increases from the first voltage level to the second voltage level in accordance with the temperature decrease in a third region between the first region and the second region.

* * * * *